US006989513B2

(12) United States Patent
Arakawa et al.

(10) Patent No.: US 6,989,513 B2
(45) Date of Patent: Jan. 24, 2006

(54) HEAT-GENERATING ELEMENT, HEAT-GENERATING SUBSTRATES, HEAT-GENERATING SUBSTRATE MANUFACTURING METHOD, MICROSWITCH, AND FLOW SENSOR

(75) Inventors: Katsuji Arakawa, Suwa (JP); Masahiro Fujii, Shiojirish-Nagano (JP); Hiroshi Koeda, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/465,842

(22) Filed: Jun. 20, 2003

(65) Prior Publication Data

US 2004/0256376 A1 Dec. 23, 2004

(51) Int. Cl.
*H05B 3/10* (2006.01)

(52) U.S. Cl. ..... 219/444.1; 219/543

(58) Field of Classification Search ..... 219/444.1, 219/543, 541, 552, 553; 338/308, 309, 314
See application file for complete search history.

(56) References Cited

U.S. PATENT DOCUMENTS 3,441,804 A * 4/1969 Klemmer ..... 338/308
4,478,076 A * 10/1984 Bohrer ..... 73/204.16
4,624,741 A * 11/1986 Daniele ..... 216/2
5,129,983 A * 7/1992 Greiff ..... 216/2
5,380,373 A * 1/1995 Kimura et al. ..... 438/436
6,323,447 B1 11/2001 Kondoh et al.
6,515,404 B1 2/2003 Wong
2001/0048014 A1 * 12/2001 Ichikawa et al. ..... 225/2
2004/0176732 A1 * 9/2004 Frazier et al. ..... 604/345
2004/0178879 A1 * 9/2004 Mitra et al. ..... 338/34
2004/0194628 A1 * 10/2004 Mitra ..... 96/101

FOREIGN PATENT DOCUMENTS

JP 06-084604 3/1994

* cited by examiner

*Primary Examiner*—Teresa J. Walberg
(74) *Attorney, Agent, or Firm*—Sterne, Kessler, Goldstein & Fox, PLLC

(57) ABSTRACT

A stable and durable heat-generating element and substrate, a method of efficient and highly precise manufacture of same, and equipment utilizing same are obtained. Employing as material a silicon substrate into at least a portion of which boron or another impurity is diffused to impart conductivity, a heater portion, in which are provided one or a plurality of slits the corner portions of which are removed or are rounded, is fabricated integrally on the silicon substrate by etching processes. Simultaneously with this, a depression portion provided below to control the heating state of the heater portion is formed integrally.

4 Claims, 16 Drawing Sheets

HEAT-GENERATING ELEMENT, HEAT-GENERATING SUBSTRATES, HEAT-GENERATING SUBSTRATE MANUFACTURING METHOD, MICROSWITCH, AND FLOW SENSOR

BACKGROUND

1. Field of the Invention

This invention relates to a heat-generating element suitable for application in, for example, a microswitch (relay), sensor, or other small-size devices in particular, as well as to a manufacturing method and so on for the same.

2. Description of the Related Art

Conventionally, electrical components (devices) called switches have been used which perform electrical opening and closing of circuits. Such switches have been reduced in size as electronic technology has advanced in order to enable incorporation in electronic components such as measurement device, and have been provided, for example, as devices called microswitches (also known as microrelays).

A microswitch performs, for example, mechanical opening and closing between solid electrodes by means of a conductive liquid metal, or performs electrode switching operations to open and close electrical contacts and effect electrical connections. In a microswitch, a plurality of electrodes (here, the case of two electrodes is explained) are formed so as to be exposed at prescribed locations on the inner walls of a long thin channel sealed with a material having electrically insulating properties. On top of this, a member having electrically conducting properties (for example, a liquid metal of gallium, a gallium alloy, mercury, or similar) is injected into the channel to form a liquid column. The length of the liquid column is equal to or greater than the distance between at least two of the electrodes. When two electrodes are to be electrically connected (switch closed), the liquid column is caused to be in contact with the two electrodes simultaneously. When two electrodes are not to be electrically connected (switch opened), the liquid column is kept from being in contact with the two electrodes simultaneously (either the liquid column is prevented from making contact with the two electrodes, or is brought into contact with only one of the electrodes).

In Japanese Patent Laid-open No. 47-21645 and Japanese Patent Laid-open No. 9-161640, a microswitch is disclosed which performs operations to open and close electrical contacts by mechanically opening and closing the space between solid electrodes using a conductive liquid.

The microswitch is provided with a substrate having a heat-generating element or member equivalent thereto which, in order to cause this liquid column to move, heats the air (or, a gas, liquid or similar which is insulating or has low conductivity) within the channel to cause expansion, such that a pressure difference arises at the two ends of the liquid column. Conventionally, a heat-generating element used in such a microswitch or similar is formed by patterning of a metal film deposited onto a substrate.

Consequently adhesion with the substrate easily becomes unstable, and there are concerns that the reliability of the switching operation may become unstable. Also, when using mercury as the conductive member, the metal film which is the heater material and mercury vapor may form an amalgam (alloy with mercury), so that the heater characteristics change. Normally in such cases a protective film is formed with an $Si_3N_4$, $SiO_2$, and the like on the heat-generating element surface in order to prevent amalgam formation; the process to form this protective film could be an extra necessary inconvenience. Also, problems with the drape properties of the protective film may result in degraded reliability. Moreover, heating efficiency may decline due to the thermal capacity of the protective film itself.

Hence an object of this invention is to obtain a heat-generating element and substrate which resolve such problems, and a method for manufacturing the same efficiently and highly accurately, as well as equipment using the same.

SUMMARY

A heat-generating element of this invention employs silicon material endowed with conductivity through diffusion of an impurity, in which are provided one or a plurality of aperture portions. Hence micromachining techniques can be used to form an element without affixing a metal film to the substrate, so that a heat-generating element with excellent stability, durability, and other properties can be obtained. And by means of one or a plurality of aperture portion, the area of contact with external gases and so on can be broadened, so that temperature-raising efficiency is satisfactory.

Further, a heat-generating element of this invention is fabricated by etching a silicon substrate. Hence a heat-generating element with high dimensional precision, capable of realizing the desired heat-generating state, can be obtained.

Moreover, the aperture portion of a heat-generating element of this invention is a slit. Therefore the area of contact with external gases and so on is broadened, and the temperature-raising efficiency is satisfactory.

In a heat-generating element of this invention, the slit has corner portions removed, or with roundness imparted to corner portions. Hence, for example in subsequent element fabrication processes, when there are wet etching processes and so on, the stress imparted to the corner portion is dispersed, and breakage of the element can be prevented.

Further, an aperture portion of a heat-generating element of this invention is a penetrating hole. Hence the area of contact with external gases and so on is broadened, and the temperature-raising efficiency is satisfactory.

Further, in a heat-generating element of this invention, the impurity used is boron. Hence it is possible to obtain an element with good conductivity using a silicon substrate. When performing wet etching, an etch-stop mechanism acts, so that a heat-generating element with good dimensional precision can be obtained.

Further, in a heat-generating substrate of this invention, a portion which generates heat through the electric power supply and a depression portion provided beneath the heat-generating portion are formed integrally in a silicon substrate. Hence even if joining with another substrate or similar is not performed, a substrate having a bottom portion beneath the heat-generating portion can be obtained. Particularly in the case of integral formation, the depression portion can be formed easily to have the desired volume with good precision. Also, by employing a suspended structure for such heat-generating portion, dispersion into the substrate of heat generated from the heat-generating portion can be reduced, so that the heat-generating efficiency can be raised. Hence when using such a heat-generating element to fabricate a microswitch or a flow sensor, it is possible to reduce the power consumption of the microswitch or flow sensor.

The above silicon substrate is a semiconductor substrate, the polarity of which is either P type or N type; it is preferable that an impurity with polarity opposite that of the above silicon substrate be diffused in the above heat-generating portion. By means of this configuration, a PN junction is formed at the portion of the heat-generating portion in contact with the both ends of the silicon substrate, so that it can be insulated between the heat-generating member comprised by the heat-generating portion and substrate, and leakage of current to the substrate can be prevented.

It is preferable that the above silicon substrate be an N-type semiconductor substrate, and that boron be diffused in the above heat-generating portion as a P-type impurity. By means of such configuration, insulation between the heat-generating member and substrate becomes possible, and by using boron an etch-stop mechanism acts when performing wet etching, so that manufacturing processes are facilitated and a heat-generating element (heat-generating portion) with good dimensional precision can be obtained.

In a heat-generating substrate of another embodiment of this invention, a plurality of pairs of a portion generating heat through power supply and a depression portion provided in the bottom of the above heat-generating portion are formed integrally on a silicon substrate, and a break groove is formed between each heat-generating portion and depression portion pair to break the substrate into chips. By means of such configuration, a substrate having a heat-generating portion and depression portion pair can be easily broken into chips at the break groove portions, without using dicing or other special means. Hence no damage to heat-generating portions (heater portions) is caused by cooling water and so on, and yields are improved.

It is preferable that the above break grooves are formed on one surface of the silicon substrate and at opposing positions on another surface of the silicon substrate. If break grooves are formed on both faces, breaking into chips is easier when thicker substrates in particular are used.

A heat-generating substrate of another embodiment of this invention has, at least, a heat-generating portion configured from one or a plurality of heat-generating members which traverse the fluid channel and both ends of which are supported by the substrate, and wiring connected to both ends of the above heat-generating members and formed on above substrate; the above wiring has, in the portion connecting the above heat-generating members and the wiring, a branched shape to enable to supply power individually to at least one of the above heat-generating members, and by cutting the wiring of this branch-shaped portion, the resistance of the above heat-generating portion can be adjusted. By having such branch-shaped wiring, changes in the resistance of the heater portion arising from scattering and so on in the thickness of the heat-generating members can be adjusted by cutting the branch-shaped wires after manufacturing the heat-generating substrate. In this way, wiring formed on the substrate is cut rather than heat-generating members, so that problems such as short-circuits due to cutting do not occur.

Further, in a heat-generating substrate manufacturing method of this invention, comprising: etching a silicon substrate from a surface to which a heat-generating portion using supplied power will be formed, to integrally form the heat-generating portion and a depression portion provided below the heat-generating portion. Hence even if a junction and so on with another substrate is not formed specially, a substrate having a bottom portion below the heat-generating portion can be obtained. By exercising this control in the etching process in particular, the depression portion can be formed precisely with the desired volume. The silicon substrate need only have a thickness equal to or greater than the heat-generating portion and depression portion thicknesses, so that there is broader latitude in selecting the silicon substrate, silicon substrate which is inexpensive and of a thickness enabling easy handling can be employed in manufacturing, and costs can be reduced.

Further, a heat-generating substrate manufacturing method of this invention has a process of diffusing impurities for imparting conductivity in at least one portion of a silicon substrate, a process of dry etching of the portion in which the impurities are diffused, to form a heat-generating portion having an aperture portion and generating heat by power supply, and, a process of forming a depression portion provided on the bottom of the heat-generating portion by wet etching of the silicon substrate from the side of the face on which the heat-generating portion is formed. Hence even if a junction with another substrate and so on is not formed specially, a substrate having a bottom portion below the heat-generating portion can be obtained. In particular, by exercising this control in the etching process, the depression portion can be formed precisely with the desired volume. The silicon substrate need only have a thickness equal to or greater than the heat-generating portion and depression portion thicknesses, so that there is broader latitude in selecting the silicon substrate, silicon substrate which is inexpensive and of thickness enabling easy handling can be employed in manufacturing, and so costs can be reduced.

Also, a heat-generating substrate manufacturing method of this invention has, at least, a process of diffusing impurities for imparting conductivity in at least one portion of a silicon substrate, a process of dry etching the portion, in which the above impurities are diffused, and forming grooves to form a heat-generating portion configured from a heat-generating member which generates heat using supplied power, and a process of forming a depression portion in the lower part of the above heat-generating portion by wet etching of the above silicon substrate from the side of the face on which the above heat-generating portion is formed; the depth D of the groove formed by the above dry etching, and the width W of the above heat-generating member, are set so as to satisfy the condition $$D > W \times \tan(54.7^\circ) \quad \text{(I)}$$

In this way, by adjusting the depth of the groove and the width of the heat-generating member such that the prescribed relation is satisfied, a depression portion can be formed reliably below the heat-generating portion.

In the process of forming the above heat-generating portion and the process of forming a depression portion in a heat-generating substrate manufacturing method of this invention, when performing dry etching and wet etching, break grooves to break the above substrate into chips are formed by means of the above dry etching and wet etching. Through dry etching and wet etching, the heat-generating portion and break grooves can be formed simultaneously, so that it is possible to manufacture a heat-generating substrate having break grooves using simple processes.

Further, a heat-generating substrate manufacturing method of this invention has, at least, a process of diffusing impurities for imparting conductivity in at least one portion of a silicon substrate, and a process of performing wet etching from the side on which impurities are diffused, to form a heat-generating portion having an aperture portion and generating heat through the supplied power as well as a depression portion provided below the heat-generating portion. Hence even if a junction and so on with another substrate is not formed specially, a substrate having a bottom portion below the heat-generating portion can be obtained.

In particular, by exercising this control in the etching process, the depression portion can be formed precisely with the desired volume. The silicon substrate need only have a thickness equal to or greater than the heat-generating portion and depression portion thicknesses, so that there is broader latitude in selecting the silicon substrate, silicon substrate which is inexpensive and of an easily handled thickness can be employed in manufacturing, and so costs can be reduced.

In a heat-generating substrate manufacturing method of this invention, after depositing a film to serve as a mask in the shape of the aperture portion formed, impurities are diffused. Hence of the portion in which impurities are diffused, the unnecessary portion can be removed by, for example, dry etching or by wet etching using an aqueous solution and so on with a concentration such that the etch-stop mechanism does not act; however, by employing a mask, highly precise wet etching can be performed.

A heat-generating substrate manufacturing method of this invention has, at least, a process of diffusing impurities for imparting conductivity in at least one portion of a silicon substrate the surface, of which is the (100) plane, and a process of performing wet etching from the side on which the above impurities are diffused, to form an aperture portion in the heat-generating portion which generates heat through supplied power, of forming sites to become one or a plurality of heat-generating members constituting the heat-generation portion, and of forming a depression portion such that at the bottom of the above heat-generating portion, side walls are composed of (111) planes, to obtain a structure in which the above heat-generating members bridge the depression portion; and is designed such that the bridging direction of the above heat-generating members obliquely intersects the direction of extension of the above depression portion. By thus setting the direction of the heat-generating members, the depression portion can be reliably formed by wet etching alone without performing dry etching. Therefore the heat-generating substrate can be manufactured without the need for single-wafer processing, so that manufacturing costs can be reduced.

Further, a heat-generating substrate manufacturing method of this invention has, at least, a process of diffusing impurities for imparting conductivity in at least one portion of a silicon substrate the surface of which is the (110) plane, and a process of performing wet etching from the side on which the above impurities are diffused, to form an aperture portion in the heat-generating portion which generates heat through supplied power, of forming sites to become one or a plurality of heat-generating members constituting the heat-generating portion, and of forming a depression portion such that at the bottom of the heat-generating portion, side walls are composed of (111) planes, to obtain a structure in which the above heat-generating members bridge the depression portion; and is designed such that the bridging direction of the above heat-generating members obliquely intersects the direction of extension of the above depression portion. By thus setting the direction of the heat-generating members, the depression portion can be formed reliably by wet etching alone, without performing dry etching. Therefore a heat-generating substrate can be manufactured without the need for single-wafer processing, so that processing costs can be reduced.

A microswitch of this invention is configured by joining a substrate, having a tube-shaped channel in one portion of which are exposed internally a plurality of electrodes, and a conductive member which, by moving within the channel, can electrically connect two or more electrodes among the plurality of electrodes, with a substrate in which are formed integrally one or a plurality of heat-generating portions to control the movement of the conductive member through pressure due to heat generation, and a depression portion provided below each heat-generating portion. Hence a protective film to protect the metal film which reacts with the conductive member need not be deposited, and to this extent processes are eliminated and so costs are reduced; and because the heat-generating efficiency rises, control of the movement of the conductive member can be performed precisely, and a microswitch with excellent responsiveness and the like can be obtained. Also, by integrally forming the portions which generate heat within the silicon substrate, excellent durability, long-term stability, and reliability can be maintained. Further, a structure is employed in which the heat-generating portion forms a bridge (is suspended), so that the power consumption of the microswitch can be reduced.

Moreover, the conductive member of a microswitch of this invention is mercury. Therefore because the conductive member is mercury, an amalgam is not formed by bonding with mercury vapor, so that there is no need to fabricate a protective film, and the advantageous results of the microswitch of this invention can be further enhanced.

Also, a flow sensor of this invention comprises, at least, a sensor portion which converts the changes in the temperature of an external gas into a signal, and a substrate, provided directly below the sensor portion, formed integrally with a heat-generating portion which heats the external gas surrounding the sensor portion and a depression portion provided below the heat-generating portion. Hence the thermal efficiency is improved, and the flow of a gas and so on can be detected efficiently with reduced power consumption.

This application relates to the Japanese Patent Application 2002-077698, filed on Mar. 20, 2002, and to the Japanese Patent Application 2003-006017, filed on Jan. 24, 2003, which include the specifications, scope of claims, drawings, and abstracts therein. The contents described in these applications are incorporated into the present application by reference, and constitute one portion of the description of this application.

DESCRIPTION OF DRAWINGS

FIG. 1 shows a substrate having a heat-generating element of a first embodiment of this invention, and shows enlarged a portion of the substrate at which is positioned the heat-generating element.

FIG. 11A is a cross-sectional view of a side face, and FIG. 11B is a cross-sectional view of an end face;

FIG. 12A is a plane view of the substrate from above, FIG. 12B is a cross-sectional view in the direction of the line A—A in FIG. 12A, and FIG. 12C is a partial enlarged view of the portion surrounded by the dashed line in FIG. 12B;

DETAILED DESCRIPTION (First Embodiment)

Figure 1A:
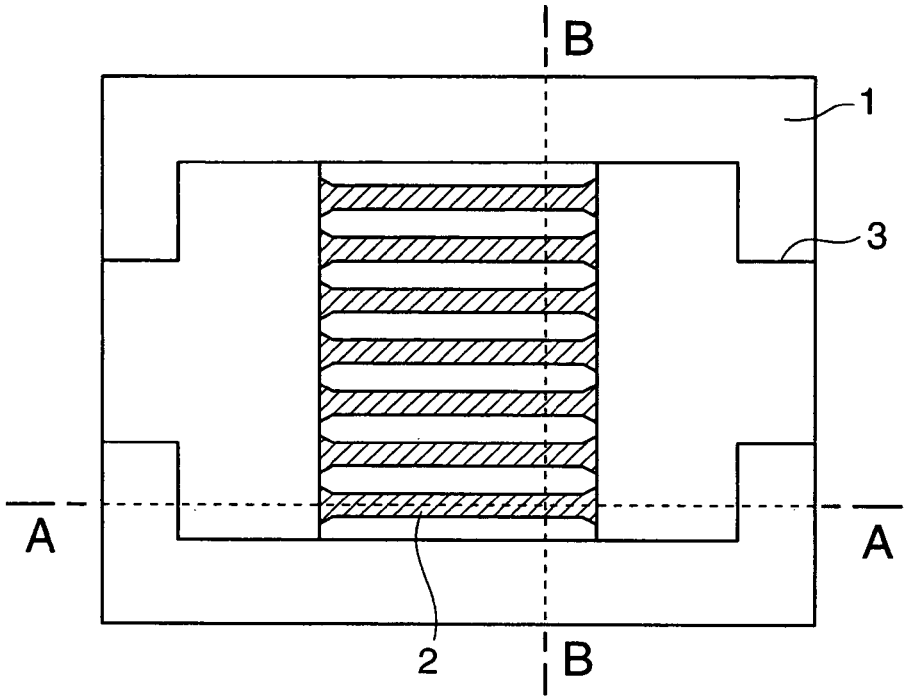
FIG. 1A is view of the substrate from above.
Figure 1B:
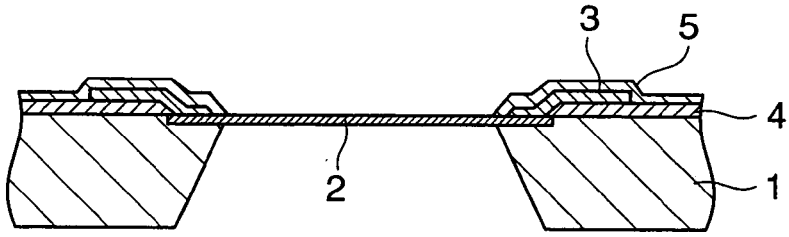
FIG. 1B is a cross-sectional view in the direction of line A—A in FIG. 1A.
Figure 1C:
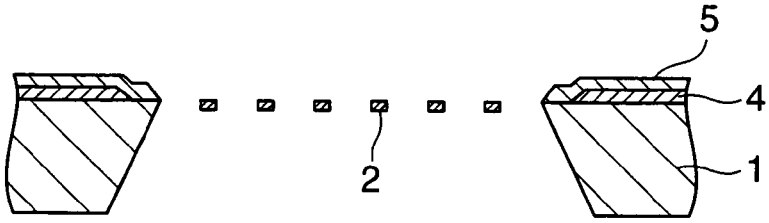
FIG. 1C is a cross-sectional view in the direction of line B—B in FIG. 1A.

FIG. 1 shows a substrate having a heat-generating element of a first embodiment of this invention, and shows enlarged a portion of the substrate at which is positioned the heat-generating element. FIG. 1A is view of the substrate from above. FIG. 1B is a cross-sectional view in the direction of line A—A in FIG. 1A. FIG. 1C is a cross-sectional view in the direction of line B—B in FIG. 1A.

The substrate 1 is a substrate formed from silicon material (and is hereafter called a silicon substrate). The heater portion (membrane) 2 is a heat-generating element which actually receives heat. In this embodiment, as the material of the heater portion 2, silicon with impurities diffused is used. As the impurities, for example, boron (B) is appropriate. Silicon in which are diffused boron or other impurities is electrically conductive.

Here, as shown in FIG. 1B, the heater portion 2 has a bridge-type structure which is suspended (hung) from the silicon substrate 1. The heater portion 2 itself has slits. The corner portions of each slit of the heater portion 2 are removed, or a roundness is imparted to the corner portions. That is, the rectangular slits have a chamfered shape. This is in order to avoid concentration of and to cause dispersion of stress in the corner portions when moving the silicon substrate 1 in the liquid during the wet etching and other processes, so as to avoid breakage of the heater portion 2 (corner portions). After fabrication also, these portions will not break easily.

The wiring 3 is used to supply power to cause the heater portion to generate heat. This wiring 3 comprises, for example, a thin film of Cr (chromium) and Au (gold). The insulating film 4 is provided for insulation with the silicon substrate 1. The insulating film 4 comprises, for example, an oxide film ($SiO_2$). The protective film 5 is provided in order to protect the wiring 3. The protective film 5 comprises, for example, an oxide film ($SiO_2$).

FIG. 2A to FIG. 2E and FIG. 3F to FIG. 3K are drawings showing processes to manufacture the heat-generating element of this embodiment. In the drawings, each drawing shown on the right side is a cross-sectional view corresponding to the direction of line A—A in FIG. 1A, and each drawing shown on the left side is a cross-sectional view corresponding to the direction of line B—B in FIG. 1A. Similarly to FIG. 1, FIG. 2 and FIG. 3 also show in enlargement the position of the silicon substrate 1 at which the heat-generating element is formed. In this embodiment, after the oxide film ($SiO_2$) 11 formed on the surface of the silicon substrate 1 is patterned, a boron-doped layer 14 is formed at the surface (hereafter called the heater surface 12) comprised of the heater portion 2, and after forming a protective film 5 for wet etching protection on the heater surface 12, the silicon substrate 1 is subjected to wet etching from the rear surface 13 of the heater surface 12 (hereafter called the rear surface 13), to obtain a chamber-shaped heat-generating element having a heater portion 2.

A manufacturing method of a heat-generating element and of a substrate having this element is explained, referring to FIG. 2 and FIG. 3.

Figure 2A:
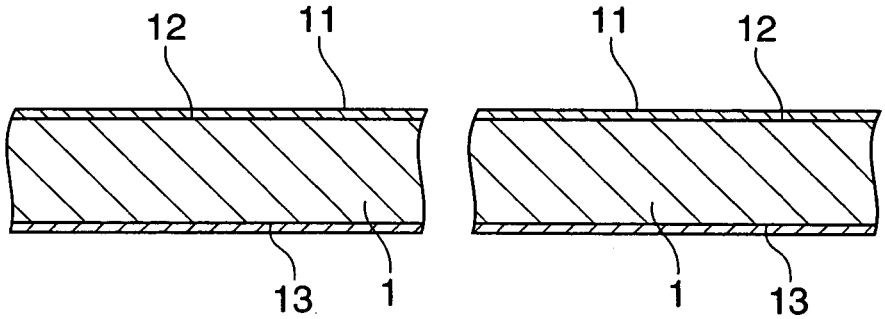
FIG. 2A through FIG. 2E are drawings of a first series of the manufacturing processes of the heat-generating element of this embodiment.
Figure 2B:
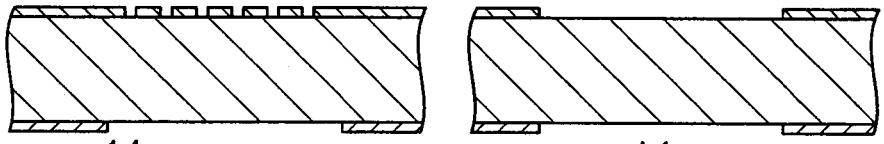

First, the heater surface 12 and rear surface 13 of the silicon substrate 1 are polished, and the thickness adjusted to approximately 140 $\mu$m. This silicon substrate 1 is placed in a thermal oxidation furnace. Thermal oxidation treatment is then performed in an oxygen and steam atmosphere at, for example, 1075° C. for four hours. By this means an oxide film 11 of thickness approximately 1.1 $\mu$m is formed on the surface of the silicon substrate 1 (FIG. 2A). Then, both surfaces of the silicon substrate 1 are coated with resist. At this time, the heater surface 12 is patterned such that the surface of the portion of the silicon substrate 1, in which boron is to be diffused is exposed. At the same time, in order to perform wet etching of the silicon below the portion, which is to become the heater portion 2, the rear surface 13 is patterned such that the rear surface of this portion of the silicon substrate 1 is exposed. The silicon substrate 1 with both surfaces subjected to resist patterning is then wet-etched, for example, in a BHF (buffered hydrofluoric) or other hydrofluoric acid aqueous solution, and after patterning the oxide film 11, the resist on both surfaces are stripped away (FIG. 2B).

Figure 2C:
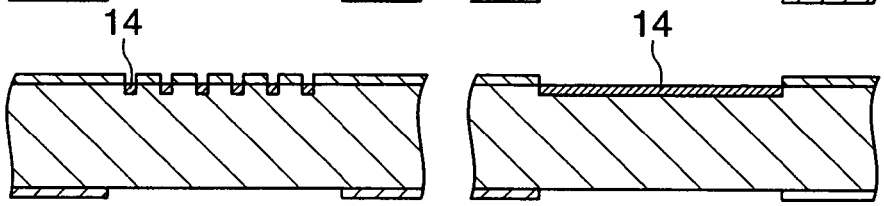

The silicon substrate 1 is set on a quartz board (not shown), such that the heater surface 12 is facing a solid diffusion source, the main component of which is $B_2O_3$. The quartz board is then set in a vertical furnace, a nitrogen atmosphere is introduced within the furnace, and the temperature is held at 1050° C. for six hours. By this means, boron is diffused in the silicon substrate 1 to form the boron-doped layer 14 (FIG. 2C). In this embodiment, the concentration in the boron-doped layer 14 is approximately $1.0\times10^{20}$ atoms/cm$^3$.

Figure 2D:
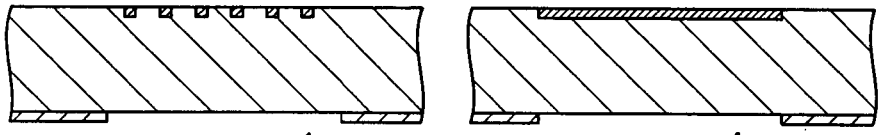
Figure 2E:
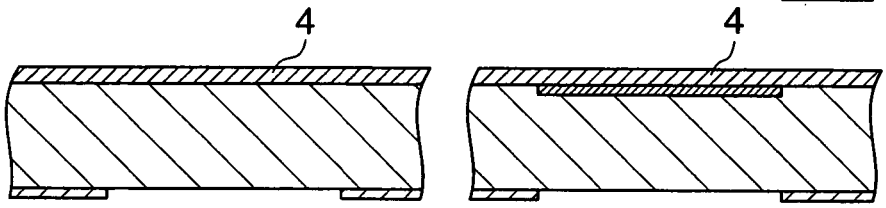

After the rear surface 13 is protected by coating with resist, wet etching is performed using a hydrofluoric acid aqueous solution to remove the oxide film 11 on the heater surface 12 (FIG. 2D). Then, the resist on the rear surface 13 is stripped away. Next a plasma CVD (chemical vapor deposition) system (not shown) is used to perform film deposition at 360° C., to form an insulating film 4 with thickness approximately 2 $\mu$m on the heater surface 12 (FIG.

Figure 3F:
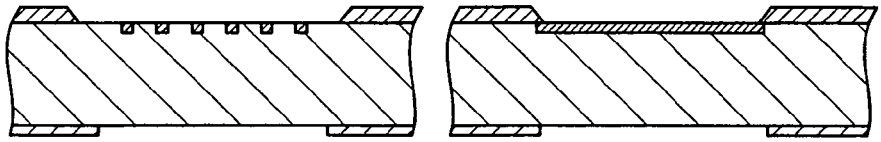
FIG. 3F through FIG. 3K are drawings of a second series of the manufacturing processes of the heat-generating element of this embodiment.

2E). After coating the portion on which the insulating film 4 is to be left with resist, a hydrofluoric acid aqueous solution is used to remove the insulating film 4 on the portion not covered with resist by wet etching. Then the resist is stripped away (FIG. 3F).

Figure 3G:
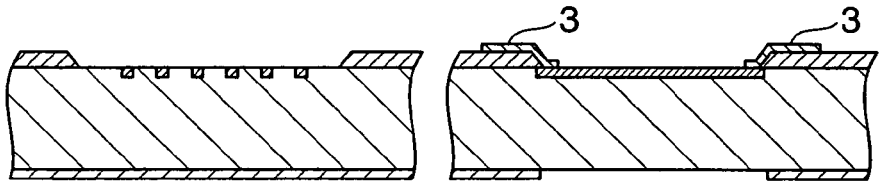
Figure 3H:
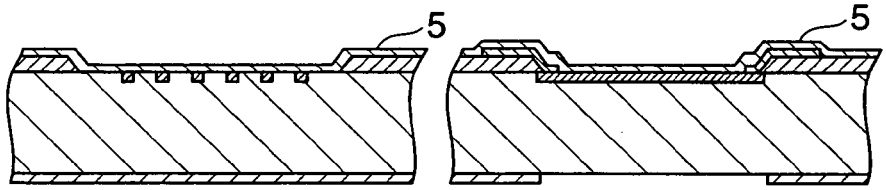
Figure 3I:
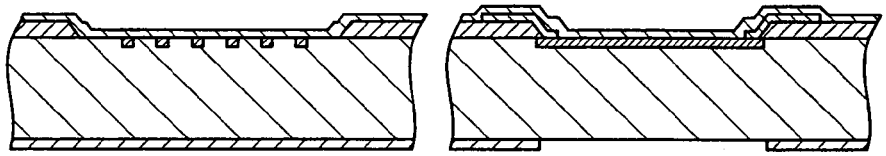

Next, the wiring 3 is formed so as to be in contact with a portion of the boron-doped layer 14 (FIG. 3G), and the plasma CVD system is again used for film deposition to form a protective film 5 with thickness approximately 2 $\mu$m on the heater surface 12 (FIG. 3H). Then, after coating the portion on which the protective film 5 is to be left with resist, a hydrofluoric acid aqueous solution is used to perform half etching of the protective film in the portion not covered with resist. Here "half etching" is an etching method which employs wet etching to remove only half of the film, without removing the entire film. Then the resist is stripped away (FIG. 3I).

Figure 3J:
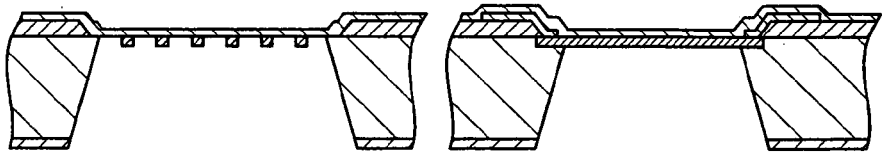

Then the silicon substrate 1 is immersed in a potassium hydroxide (KOH) aqueous solution of concentration 35 weight percent to perform wet etching until the thickness of the portion which is not patterned becomes approximately 10 $\mu$m. Then the silicon substrate 1 is immersed in a potassium hydroxide aqueous solution of concentration 3 weight percent to perform wet etching (FIG. 3J). Here, when wet etching of silicon is performed using an alkaline aqueous solution, if the dopant is boron, the etching rate is greatly reduced in regions where the concentration is high (approximately $5\times10^{19}$ $cm^{-3}$ or higher). When etching reaches the boron-doped layer 14, the etching rate decreases, and etching stops. When etching stops, air bubbles no longer occur at the etched surface, and so the fact that etching is stopped can be judged from the cessation of air bubbles.

Figure 3K:
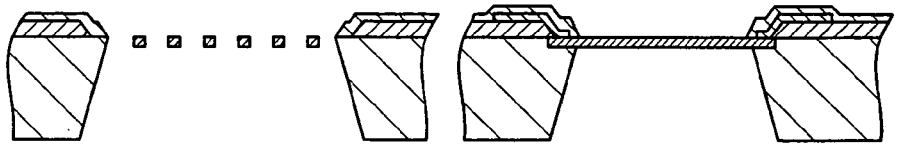

Then, after coating the portion in which the protective film 5 is to be left, with resist in order to remove only the protective film 5 deposited on the heater portion 2, half etching using a hydrofluoric acid aqueous solution is again performed. Then the resist is stripped away, and a substrate having a heat-generating element is completed (FIG. 3K).

Figure 4:
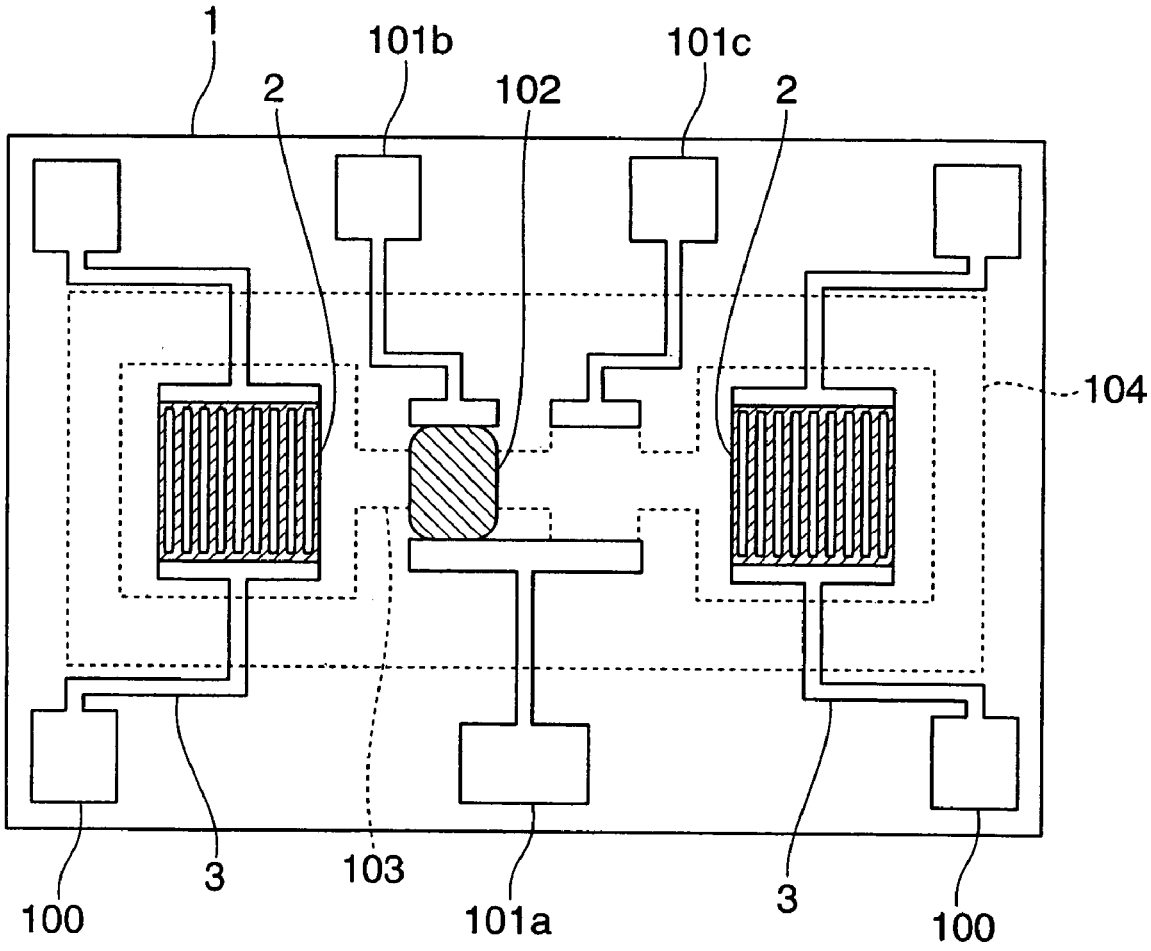
FIG. 4 is a drawing showing one example of a fabricated microswitch.
Figure 5A:
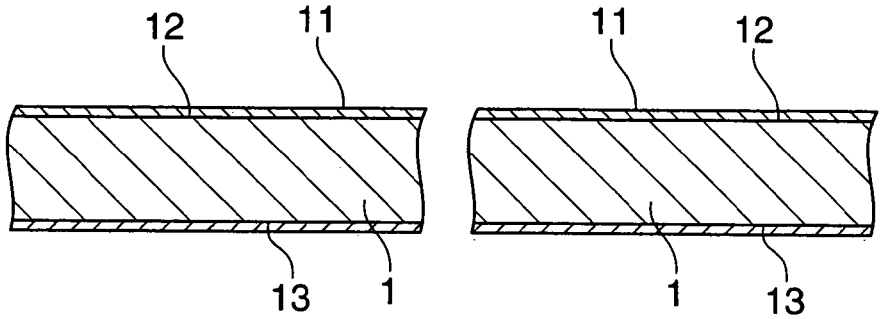
FIG. 5A through FIG. 5F are drawings of a first series of the manufacturing processes of the heat-generating element of a second embodiment of this invention.
Figure 5B:
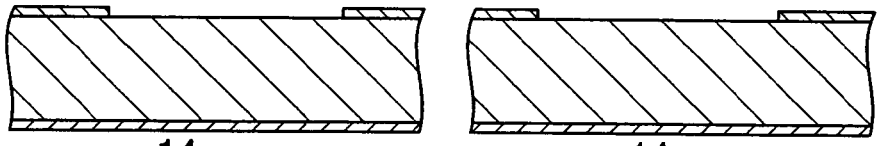
Figure 5C:
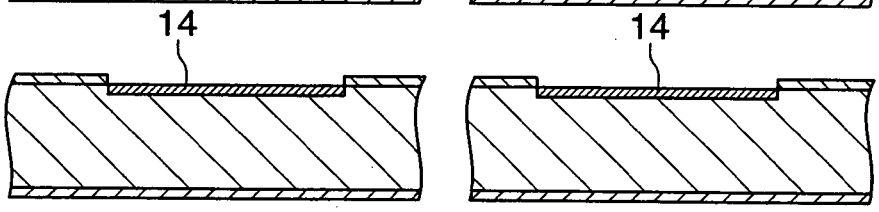
Figure 5D:
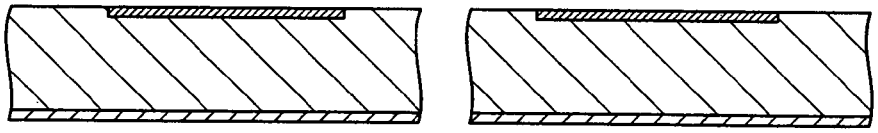
Figure 5E:
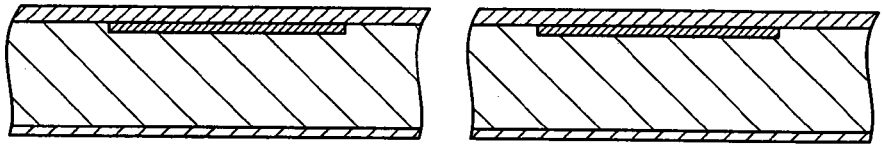
Figure 5F:
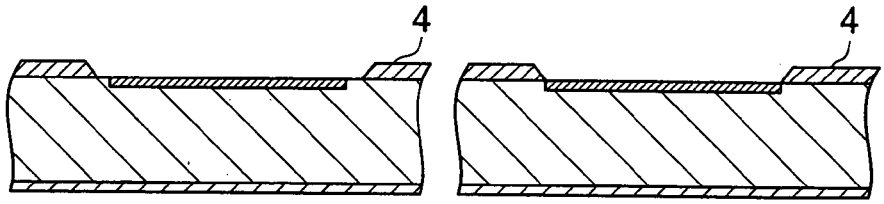

FIG. 4 shows one example of a microswitch. In FIG. 4, the heater electrode 100 is connected to one end of the wiring 3. Power is supplied to the heater portion 2 from outside via the heater electrode 100 and wiring 3 to cause the heater portion 2 to generate heat. The electrodes 101*a*, 101*b* and 101*c* are for signal input and output. A portion of each of the electrode 101*a*, the electrode 101*b* and the electrode 101*c* is exposed from the channel 103, and is in contact with the liquid metal 102. The liquid metal 102 has the conductive properties of, for example, mercury, and is used as a liquid column to electrically connect either the electrode 101*a* with the electrode 101*b*, or the electrode 101*a* with the electrode 101*c*. The channel 103 encloses the liquid metal 102. The channel 103 is formed with, for example, a groove formed in the upper substrate 104 and the silicon substrate 1 as side walls. In the lower part of the upper substrate 104 (the joint surface with the substrate having the heat-generating element), a groove (chamber) which is a space having, for example, the channel 103 and heater portion 2 is formed.

The upper substrate 104 is bonded to the upper surface of the substrate having the heat-generating element thus fabricated using an adhesive, anodic bonding, or other means; a support substrate called a base substrate (not shown) is similarly bonded to the lower surface, to eventually manufacture the microswitch. Here, in the microswitch shown in FIG. 4, either the electrode 101*a* and the electrode 101*b*, or the electrode 101*a* and the electrode 101*c*, are always electrically connected; however, the microswitch is not limited to this form, but may be configured as a microswitch and the like, which opens and closes two electrodes, or as a microswitch with a different configuration.

The heater portion 2 is in a suspended (hanging-down) state in the sealed space formed by the upper substrate 104 and the chamber (groove) provided in the base substrate. Here, the temperature rise tendencies within this space differ according to the volume of the space. That is, the larger the space, the more gradual is the temperature increase, and more time is required until pressure causes the liquid column to be moved. Consequently the switching response become slower. Therefore finishing the space to the desired volume with good precision is extremely important to the switch performance.

As explained above, by means of this first embodiment, a silicon substrate 1 is etched and otherwise processed to fabricate a heater portion 2 to become a heat-generating element (heat-generating portion) using silicon material; hence by using micromachining techniques a miniature heat-generating member can be easily fabricated, without affixing metal film to the substrate. Consequently there is no peeling of metal film from the substrate resulting from deformation due to heating or other causes, and the silicon substrate 1 and heater portion 2 can be formed integrally, so that excellent durability, long-term stability and reliability can be maintained. When a slit or other aperture portion is formed in order to enhance heat-generating efficiency, the slit is formed with the corner portions of the slit rounded, so that when for example the silicon substrate is moved in a solution during a subsequent wet etching process, or when a force is brought to bear on a corner portion after fabrication, the force is dispersed and breakage of the heater portion 2 can be prevented. Also, if this heat-generating element is used in a microswitch employing a liquid metal (and in particular mercury), there is no formation of an amalgam through bonding with mercury vapor, so that a protective film need not be formed on the heat-generating portion. Consequently processes to form a protective film are eliminated so that costs can be reduced, and the heat-generating efficiency is increased, so that a microswitch with excellent responsiveness and other properties can be obtained. And by employing a bridge (suspended) structure for the heat-generating portion, the escape of heat from the heat-generating portion into the substrate can be reduced, so that the heat-generating efficiency can be improved. Hence when manufacturing a microswitch or flow sensor by employing such a heat-generating substrate, the power consumption of the microswitch or flow sensor can be decreased.

(Second Embodiment)

FIG. 5A through FIG. 5F and FIG. 6G through FIG. 6M show processes to manufacture the heat-generating element of a second embodiment of the invention. Each drawing shown on the right side is a cross-sectional view corresponding to the direction of line A—A in FIG. 1A, and each drawing shown on the left side is a cross-sectional view corresponding to the direction of line B—B in FIG. 1A. In this embodiment, an oxide film ($SiO_2$) 11 formed on the surface of the silicon substrate 1 is patterned, then a boron-doped layer 14 is formed at the surface which consists of the heater portion 2 (hereafter called the heater surface 12), and after forming a protective film 5 on the heater surface 12 to protect from wet etching, dry etching and wet etching of the silicon substrate 1 are performed from the heater surface 12, to simultaneously form a space enclosed by the heater portion 2 and the surface below the heater portion 2. That is, a chamber-shape heating element having a heater portion 2 is obtained.

The manufacturing method of the heating element is explained referring to FIG. 5 and FIG. 6. By this means, a substrate having the heat-generating element of the first embodiment is formed integrally with the base substrate, without performing wet etching from the rear surface 13. Consequently the volume (chamber volume) of the space (chamber) of the heater portion 2 can be easily adjusted.

In the processes from FIG. 5A through FIG. 6I, treatment similar to that of the processes of FIG. 2A through FIG. 3I in the above-described first embodiment is performed, and so an explanation is omitted. However, because in later processes dry etching is performed, in the process of FIG. 5B it is sufficient to perform patterning such that the surface of the silicon substrate 1 in which boron is to be diffused be exposed, as opposed to the entire region of formation of the heater portion 2, and so there is no need to perform patterning in the same shape as the heater portion 2, as in the case of FIG. 2B. Hence the pattern formation can be simplified. Also, wet etching from the side of the rear surface 13 is not performed in this embodiment, so that patterning of the rear surface 13 is not performed, as in the first embodiment. However, patterning in the same shape as the heater portion 2 may be performed here as well.

Figure 6G:
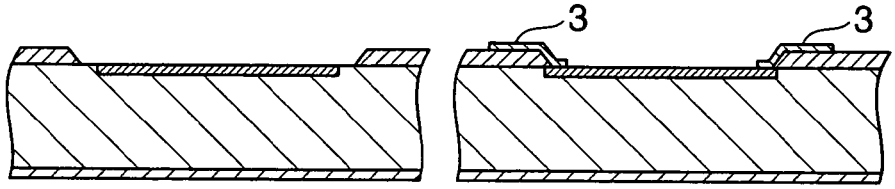
FIG. 6G through FIG. 6M are drawings of a second series of the manufacturing processes of the heat-generating element of the second embodiment of this invention.
Figure 6H:
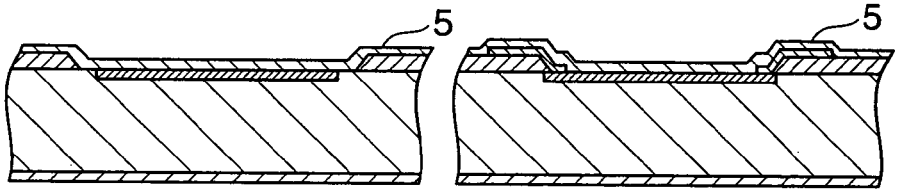
Figure 6I:
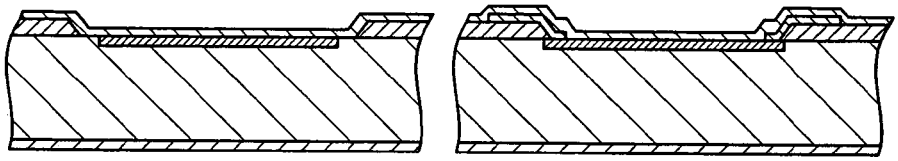
Figure 6J:
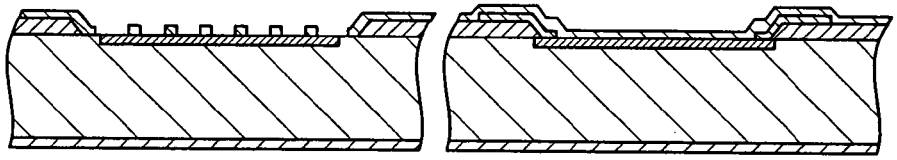

The protective film formed in the process shown in FIG. 6I is covered with resist, and after patterning the protective film 5 of the heater surface 12 into the heater shape, the resist is removed (FIG. 6J). By means of this process, the protective film is removed in the portion in which the aperture portion is formed, and protective film remains only in the portion which is to become the heat-generating member comprising the heater portion.

Figure 6K:
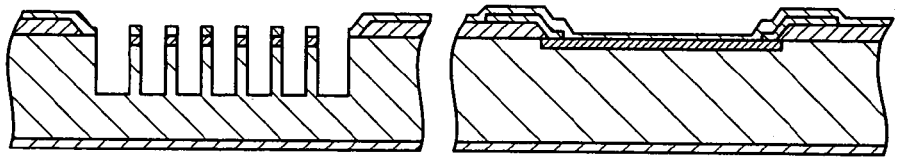

In an ICP dry etching system (not shown), the heater surface 12 is subjected to anisotropic dry etching by ICP discharge (FIG. 6K). Here "ICP discharge" is inductively coupled plasma discharge. As the etching gas, for example, carbon fluorides (CF, $CF_4$) or sulfur hexafluoride ($SF_6$) is used; these etching gases may be used in alternation. Here CF is used in order that etching of the side walls of the newly formed groove does not occur, thus protecting the groove side surfaces, and $SF_6$ is used in order to promote etching of the silicon wafer in the perpendicular direction. As other anisotropic dry etching methods, ECR (electron cyclotron resonance) discharge, HWP (helicon wave plasma) discharge, and RIE (reactive ion etching), or similar methods, may be used.

Instead of performing the above dry etching, the substrate may be immersed in a potassium hydroxide (KOH) aqueous solution, and the silicon other than the boron-doped layer subjected to anisotropic wet etching. It is desirable that etching of the boron-doped layer at the beginning of etching employ a potassium hydroxide aqueous solution at a high concentration for which the etch-stop mechanism does not act, for example, a potassium hydroxide aqueous solution with a concentration of 35 weight percent. In this case, patterning of the thermal oxide film 11 is performed at a fixed angle with respect to crystal directions in the silicon substrate 1. In this case, wet etching alone can be used for groove formation and silicon etching, and a heater portion 2 can be formed with comparative ease.

Figure 6L:
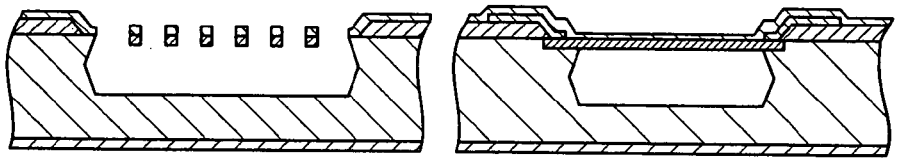

Then, the silicon substrate 1 is immersed in a potassium hydroxide aqueous solution with a concentration of 3 weight percent to remove the silicon remaining below the boron-doped layer 14, performing wet etching of the silicon substrate 1 to the desired depth (FIG. 6L).

Figure 6M:
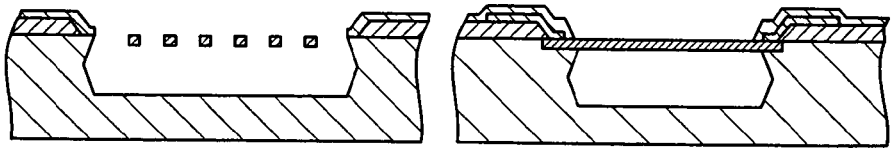

Then after coating the portion in which a protective film 5 is to be left with resist in order to remove only the protective film 5 deposited in the portion of the heater portion 2, half etching is again performed using a hydrofluoric acid aqueous solution. The resist is stripped away, and a substrate having a heat-generating element is completed (FIG. 6M).

As explained above, a substrate with channel formed is bonded to the upper surface of the newly fabricated substrate having the heat-generating element to manufacture the microswitch.

In each of the above processes of FIG. 6K and FIG. 6L, to be more precise, it is preferable that etching be performed to satisfy the following specific conditions.

In order words, in the above-described dry etching process (FIG. 6K), the depth D of the groove formed by dry etching and the width W of the heat-generating member comprising the heater portion 2 should be set such that the following equation (I) is satisfied.

$$D > W \times \tan(54.7^\circ) \quad \text{(I)}$$

By setting the depth D of the groove formed by dry etching and the width W of the heat-generating element in this way, during wet etching the groove formed below the heat-generating element by dry etching and an adjacent groove can be penetrated, enabling reliable separation (release) of the groove bottom surface of the heat-generating member, and a depression portion can be reliably formed at the bottom of the heat-generating portion.

The above equation (I) is explained in greater detail below.

FIG. 7A through FIG. 7D and FIG. 8 are diagrams to explain the relation between the depth D of the groove formed by dry etching and the width W of the heat-generating member. First, the process of formation of the depression portion is described briefly, referring to FIG. 7.

Figure 7A:
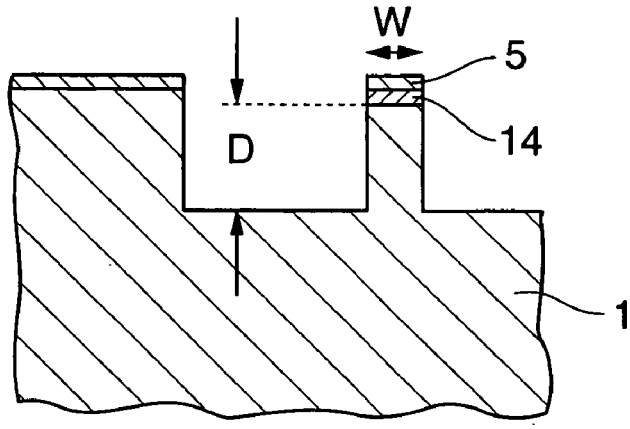
FIG. 7A through FIG. 7D are drawings to explain the relation between the depth D of a groove formed by dry etching, and the width W of the heat-generating element.
Figure 7B:
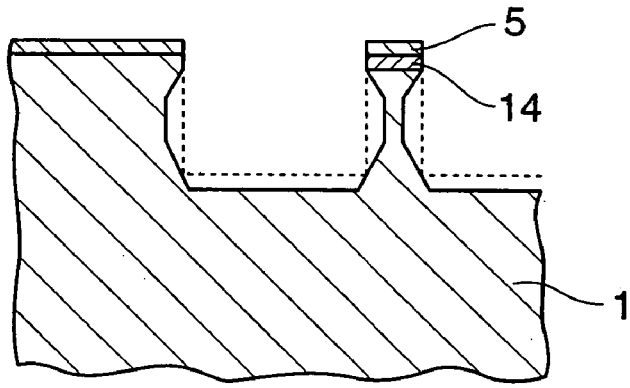
Figure 7C:
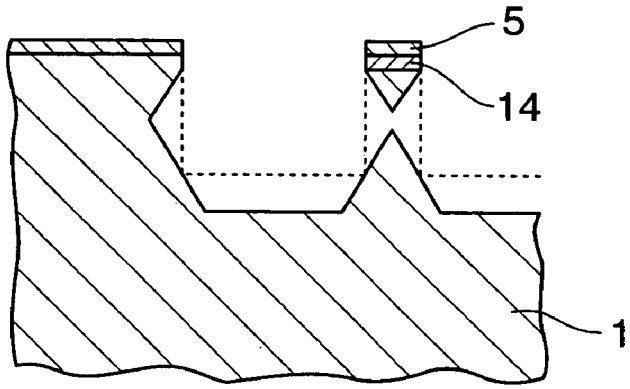
Figure 7D:
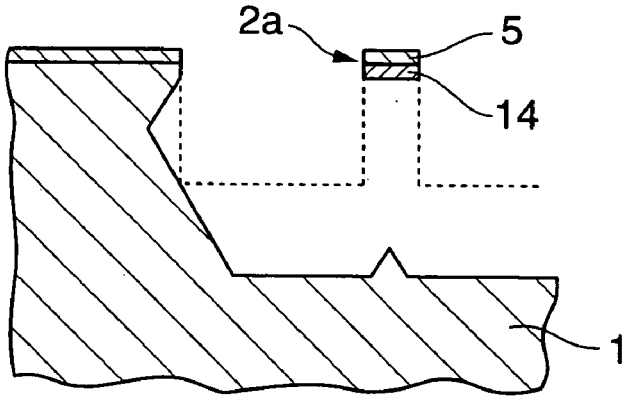

FIG. 7A shows the silicon substrate 1 after dry etching. When this silicon substrate 1 is immersed in for example a potassium hydroxide aqueous solution and so on for anisotropic etching to start etching, etching occurs in the side directions and the depth direction within the groove formed by dry etching (FIG. 7B). When wet etching occurs, the side surface of an adjacent groove is consumed, so that finally adjacent grooves are linked (penetrated) at the bottom of the heat-generating member which ultimately constitutes the heat-generating portion (FIG. 7C). Then, the silicon substrate 1 remaining at the bottom of the heat-generating member is etched vertically from the penetrating portion, so that finally only the boron-doped layer 14 is left, and the heat-generating member 2*a* is separated from the bottom surface of the groove (or depression portion) (FIG. 7D).

Figure 8:
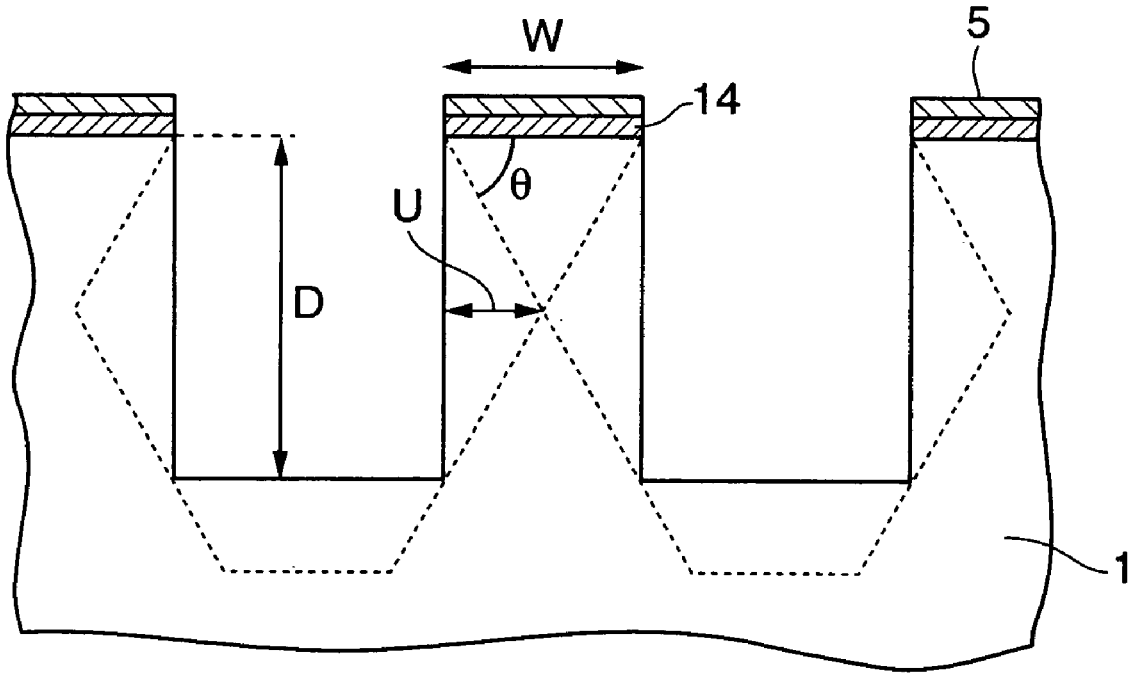
FIG. 8 is a drawing to explain the relation between the depth D of a groove formed by dry etching, and the width W of the heat-generating element.

Here, in order for the heat-generating member 2*a* to be separated from the bottom of the groove (or depression portion), it is necessary that the etching portion proceeding in the side directions below the heat-generating member 2*a* penetrate the side wall, as shown in FIG. 8. Hence the following relation needs to be obtained between the side etching amount U and the width W of the heat-generating member.

$$U > W/2 \quad \text{(I-1)}$$

On the other hand, when using silicon substrate with a (100) surface orientation, due to anisotropic etching the side etching proceeds at an oblique angle of 54.7° with respect to the silicon substrate, as indicated by the dashed lines in FIG. 8. Hence the following relation is obtained between the side etching amount U and the depth D of the groove formed by dry etching.

$$U = (D/2)/\tan(54.7^\circ) \quad \text{(I-2)}$$

From the relationship of above equation (I-1) and (I-2), the following equation (I) is derived.

$$D>W\times\tan(54.7°) \quad \text{(I)}$$

Hence by securing an etching depth D so as to satisfy the relation of above equation (I) for a heat-generating member width W, a depression portion can be reliably formed below the heat-generating portion.

In the process shown in the above FIG. 6K, when performing wet etching in place of dry etching, it is preferable that the heat-generating member 2*a* be positioned such that the bridge direction of the above heat-generating member and the direction of extension of the above depression portion are oblique. The specific method of placement of the heat-generating member 2*a* with respect to the silicon substrate 1 is explained referring to FIG. 9.

Figure 9A:
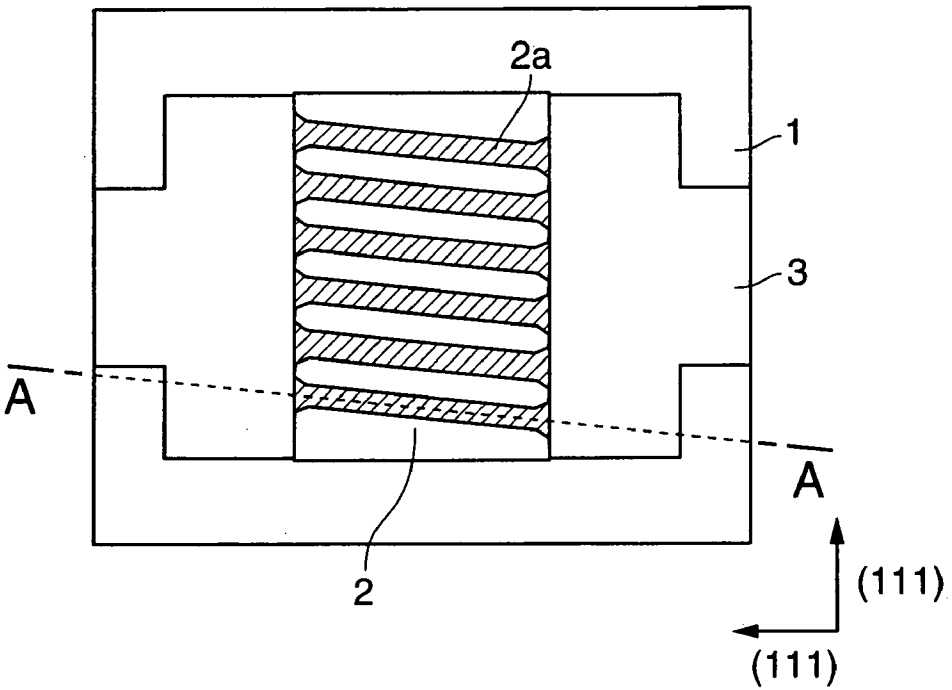
FIG. 9A through FIG. 9C are drawings to explain the relation between the depression portion formed by wet etching, and the positioning of the heat-generating member.
Figure 9B:
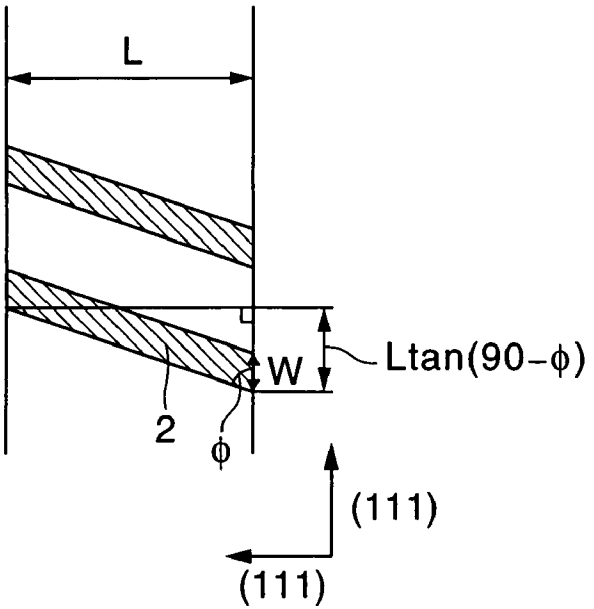
Figure 9C:
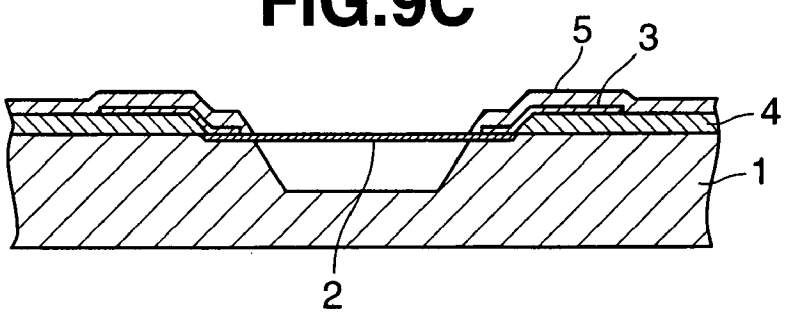

FIG. 9 is a drawing to explain the relation between the depression portion formed by wet etching and the position of the heat-generating member. FIG. 9A is a plane view showing one portion of a heat-generating substrate positioned such that, in a silicon substrate the surface of which is the (100) plane, the bridge direction of the heat-generating member and the direction of extension of the depression portion are mutually oblique. FIG. 9B is a drawing which explains specifically the relation between the bridge direction of the heat-generating member and the direction of extension of the depression portion; FIG. 9C is a cross-sectional view in the direction of line A—A in FIG. 9A.

As shown in FIG. 9A, when the depression portion is formed below the heat-generating member 2*a* by wet etching alone, it is preferable that a design be employed such that in the silicon substrate 1 the surface of which is the (100) plane, the bridge direction of the heat-generating member 2*a* and the direction of extension of the depression portion are mutually oblique.

For example, when employing anisotropic etching using a potassium hydroxide (KOH) aqueous solution and so on, side etching proceeds such that the (111) plane appears. Hence if the bridge direction of the heat-generating member 2*a* is designed so as to be oblique to the direction of extension of the depression portion, the side etching portions proceeding from both sides below the micro-bridge (heat-generating member) become linked, and the micro-bridge is undercut. Consequently it is possible to form the depression portion reliably beneath the heater portion 2 by wet etching alone. Also, because dry etching is not necessary, manufacturing can be performed without employing single-wafer processing, and process costs can be reduced.

Specifically, the bridge direction of the heat-generating element and the direction of extension of the depression portion are set such that, as shown for example in FIG. 9B, if the length of a vertical line from the vertex of the heat-generating member to the opposite edge is L, and the width of the heat-generating member is W, then the angle $\phi$ made by the bridge direction of the heat-generating member with the direction of extension of the depression portion can be set so as to satisfy the relation of the following equation (II).

$$L\times\tan(90-\phi)>W \quad \text{(II)}$$

Here the width W of the heat-generating member is the length along a line parallel to the direction of extension of the depression portion, and if the width of the heat-generating member is not constant, the widest portion is taken to be W.

By setting the above angle $\phi$ in this way, and performing wet etching such that the (111) plane appears, the depression portion can be formed more reliably below the heat-generating member 2*a*.

In order to form the heat-generating member 2*a* obliquely to the direction of extension of the depression portion in this way, the mask pattern formed in the process shown in the above FIG. 6J should be formed so as to satisfy the above relation.

Similarly in the case of a silicon substrate 1 the surface of which is the (110) plane, it is preferable that the direction of extension of the depression portion and the bridge direction of the heat-generating member 2*a* be designed so as to be oblique. By employing such a design, the depression portion can be formed more reliably below the heat-generating member having the desired width (for example several tens of microns). The explanation for the case of use of a silicon substrate the surface of which is the (100) plane can also be referenced appropriately when using a silicon substrate the surface of which is the (110) plane.

By means of the above second embodiment, dry etching and wet etching are used in processing performed only from the side of the heater surface 12, so that the base substrate need not be newly formed and bonded. Moreover, the volume of the space formed below the heater portion 2 can be controlled by adjustments to the etching, so that the space volume, which affects the switching responsiveness and other properties, can be controlled more precisely during manufacture of the microswitch. Also, because of the possibility of such manufacturing, the limitation on the thickness of the silicon substrate 1 used is eliminated, and a silicon substrate which is inexpensive and of an easily handled thickness can be employed to manufacture a substrate having a heater portion 2, so that manufacturing costs can be decreased.

(Third Embodiment)

Figure 10A:
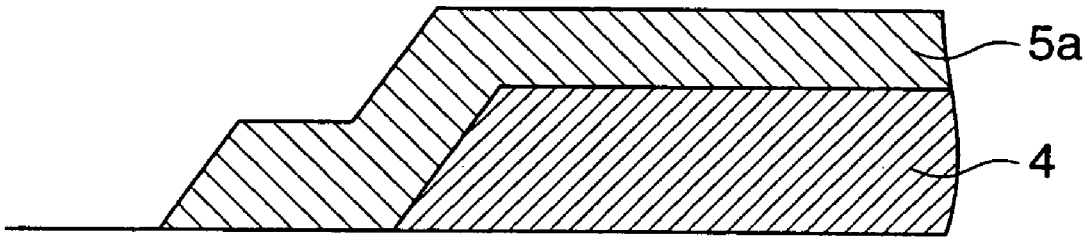
FIG. 10A and FIG. 10B are drawings showing the depositing processes of a protective film in a third embodiment of this invention.
Figure 10B:
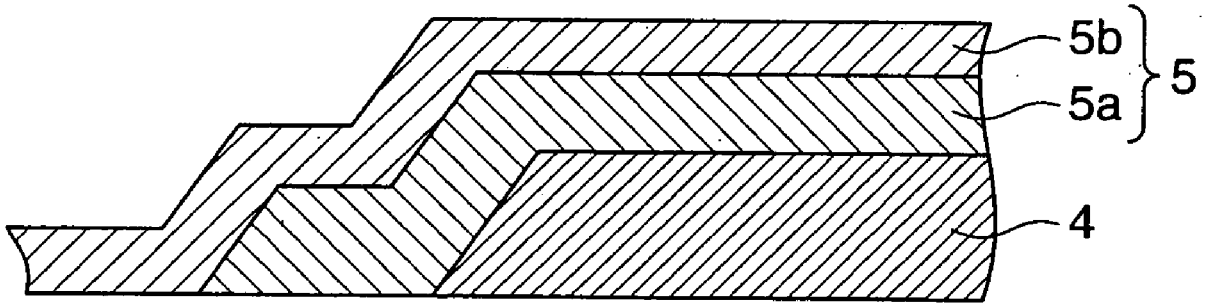

FIG. 10A and FIG. 10B are diagrams showing processes to deposit the protective film 5 in a third embodiment of this invention. In the process shown in FIG. 3I in the above-described first embodiment, by performing half etching a film is finished to serve as the protective film 5 with the shape shown in the drawing. In this embodiment, by forming the film to serve as the protective film 5 in two stages, the film is finished in a shape like that shown in FIG. 3I.

Consequently in place of the process of FIG. 3I explained in the first embodiment, processing employs the following process. First, a plasma CVD system is used to deposit a film on the insulating film 4 and wiring 3, to form a first-stage film 5*a* as shown in FIG. 10A. Then, the plasma CVD system is again used in film deposition, to deposit a second-stage film 5*b* as shown in FIG. 10B, and by this means a shape such as that shown in FIG. 3I is obtained. By such formation in two stages, the film is deposited without performing half etching, and a protective film 5 with a shape similar to that shown in FIG. 3I can be formed.

(Fourth Embodiment)

In the above-described embodiments, a plurality of slits were provided in the heater portion 2 in order to increase the contact area with the outside and improve thermal efficiency; however, this invention is not limited thereto, and for example another aperture portion such as for example a penetrating hole may be opened in the heater portion 2 to improve the thermal efficiency. In this case, as the penetrating hole a square shape is conceivable; but as explained above, stress is concentrated in the corner portions during processes in which wet etching is performed, and so a round hole is preferable.

(Fifth Embodiment)

Figure 11A:
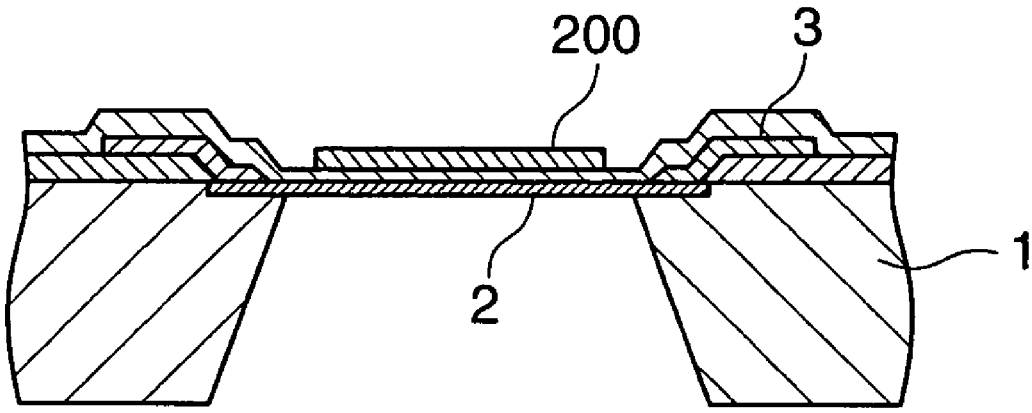
FIG. 11A and FIG. 11B are drawings showing a flow sensor (gas sensor) of a fifth embodiment of this invention.
Figure 11B:
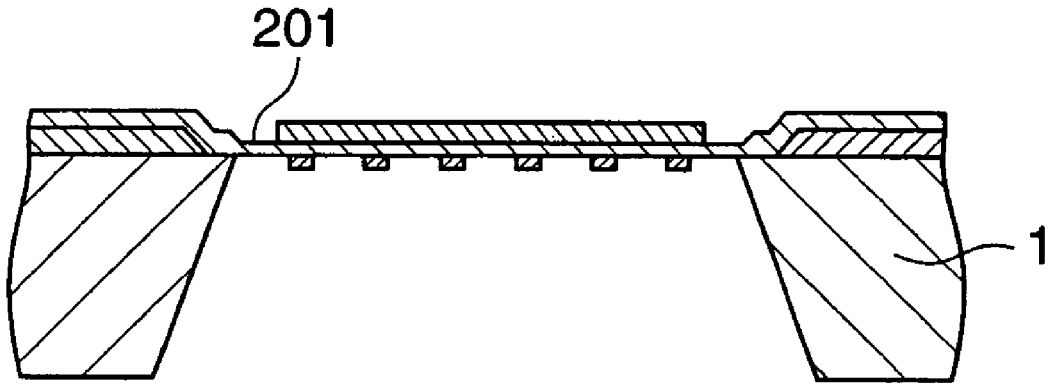

FIG. 11A and FIG. 11B are cross-sectional views of one example of a flow sensor (gas sensor) of a fifth embodiment of this invention. FIG. 11A is a cross-sectional view of a side face, and FIG. 11B is a cross-sectional view of an end face. The flow sensor causes the heater portion 2 to generate heat in the midst of a flow of gas, and based on the temperature change therein (extent of temperature decrease), the gas flow rate is detected.

The sensor portion 200 shown in FIG. 11 is formed using, for example, tin oxide, indium oxide, zinc oxide, tungsten oxide, titanium oxide, iron oxide, and so on. This sensor portion 200 undergoes, for example, a change in voltage based on a change in temperature of the external gas. This is transmitted as a signal to external processing equipment. In order to be used as a gas sensor, the sensor portion 200 is heated to between approximately 250° C. and approximately 450° C. Here, though not shown in FIG. 11 specifically, an electrode to capture the signal (normally, a voltage or other electrical signal) accompanying a change in temperature is connected to the sensor portion 200.

The thin sheet portion 201 is formed from an oxide film serving as an insulating film. Hence in terms of the processes explained in the above-described embodiments, this thin sheet may be formed integrally with the protective film 5. In this case, the thin sheet 201 may be formed in the shape shown in FIG. 3J without performing half etching from the process shown in the above-described FIG. 3H, or etching into the shape shown in FIG. 3I may be performed, to provide the thin sheet portion 201 into the desired thickness. As in the second embodiment, there is a bottom portion below the heater portion 2; when a space which is not open is formed integrally, the sensor portion 200 may be mounted in a state in which the oxide film serving as the protective film 5 is deposited on the heater portion 2, as in the process shown in FIG. 6L and explained in the second embodiment.

When adopting a configuration such as that of this embodiment, the heater portion 2 is formed directly below the sensor portion 200, so that thermal efficiency is improved and power consumption can be greatly reduced. Also by providing a bottom portion below the heater portion 2 and not opening the space, similarly to the second embodiment, the efficiency is further improved.

(Sixth Embodiment)

In the above-described embodiments, methods of forming a heat-generating element and substrate to be used in a microswitch and sensor in particular were explained. The present invention is not limited thereto; for example, application to a device employed in heating objects or for other uses is possible. Micromachining techniques are utilized, so that this invention is particularly useful when forming miniaturized devices. Also, boron is used as the impurity to impart conductivity, but this invention is not limited thereto, and any impurity may be used which imparts conductivity and results in more difficult etching than pure silicon.

(Seventh Embodiment)

Figure 12A:
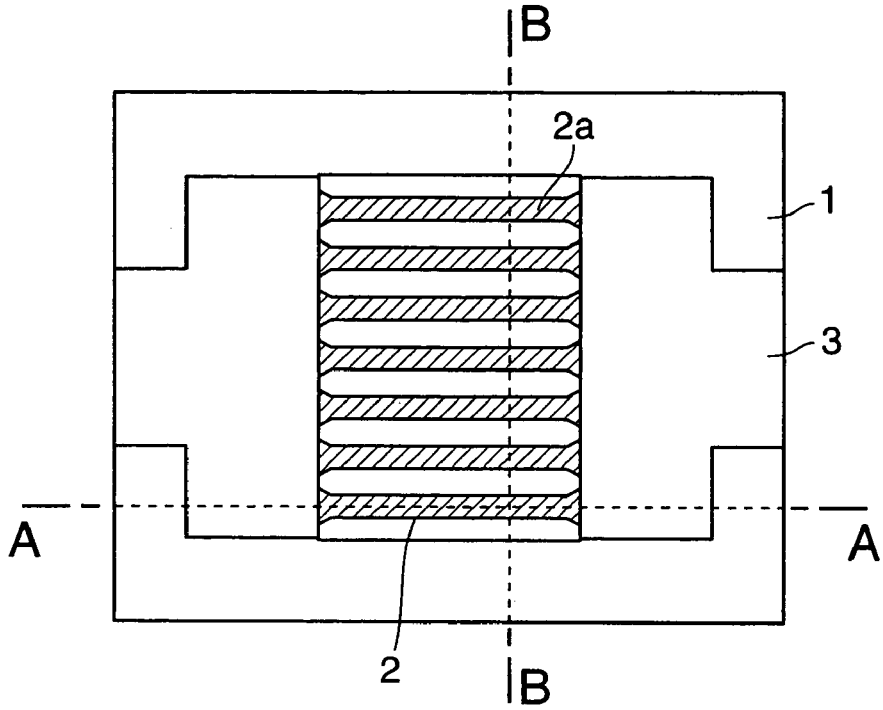
FIG. 12A through FIG. 12C are drawings showing the structure of the heater portion of the microswitch of a seventh embodiment of this invention.
Figure 12B:
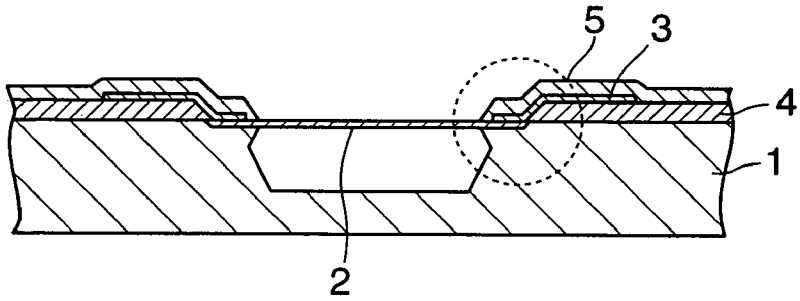
Figure 12C:
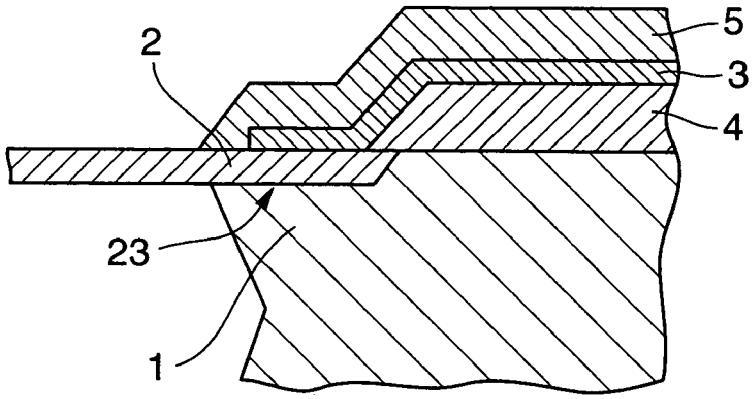

FIG. 12 shows the structure of the heater portion of the microswitch of a seventh embodiment. FIG. 12A is a plane view from above of the substrate. FIG. 12B is a cross-sectional view in the direction of line A—A in FIG. 12A, and FIG. 12C is a partial enlarged view of the portion surrounded by the dashed line in FIG. 12B.

As shown in FIG. 12A, the heater portion 2 has a plurality of slit-shape aperture portions. Hence the heater portion 2 comprises a plurality of strip-shaped portions (heat-generating members) which actually take on heat. Wiring 3 is formed at both ends of the heater portion 2 for electrical connection to an external circuit. As shown in FIG. 12B, a depression portion is formed below the heater portion 2, and the heat-generating members have a bridge-structure which covers the depression portion.

In this embodiment, the substrate 1 comprises an N-type silicon substrate, and the heater portion 2 comprises P-type silicon in which boron is diffused. Hence as shown in FIG. 12C, a PN junction 23 is formed between the substrate 1 and the heater portion 2. The PN junction 23 is formed at both ends of the heater portion 2, so that due to the diode characteristics of the PN junctions 23, leakage of current from the heater portion 2 to the substrate 1 can be prevented.

The heat-generating substrate of this embodiment can be manufactured by a method similar to that described in the second embodiment, except that an N-type silicon substrate is used as the substrate 1.

In this embodiment, the substrate 1 comprises N-type silicon, and the heater portion 2 comprises P-type silicon; however, the substrate 1 may be P-type silicon, and the heater portion 2 may be N-type silicon. Such a substrate can be manufactured using, for example, an electrochemical etch-stop method.

(Eighth Embodiment)

Figure 13:
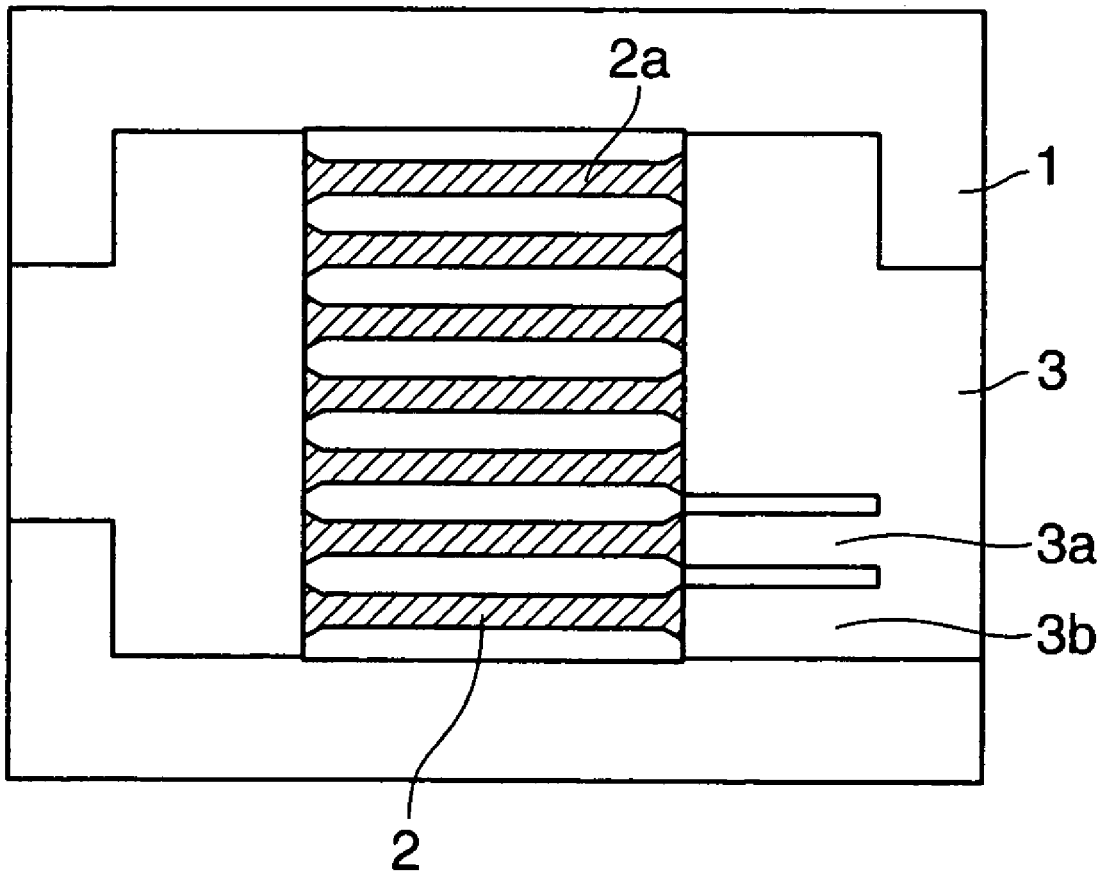
FIG. 13 is a plane view showing the structure of the heater portion of the microswitch of an eighth embodiment of the invention.

FIG. 13 is a plane view showing the structure of the heater portion 2 of the microswitch of an eighth embodiment. The heater portion 2 comprises one or a plurality of heat-generating members, provided so as to traverse the fluid channel (depression portion) which is the path of air warmed by the heater; both ends are supported by the substrate 1. The wiring 3 is formed on the substrate 1, and is connected to both ends of the heat-generating members. One portion of the wiring has, in the portion connected with the heat-generating members, a branched shape, to enable to supply power individually to at least a portion of the heat-generating members. Specifically, as shown in the drawing, branched wiring 3*a* and wiring 3*b* are formed. Thus by cutting this branch-shaped wiring, or wiring 3*a* and 3*b*, the resistance of the heater portion 2 (heat-generating portion) can be adjusted. For example, the resistance of the heater portion 2 is reduced due to scattering in the thickness of the heat-generating members or for other reasons, so that the amount of heat generation of the heater portion 2 may be reduced. In such a case, by using a laser and the like means to cut either wiring 3*a* or wiring 3*b*, or both, in the branched portion, so that current does not flow in the heat-generating members connected to this wiring, the resistance of the heater portion 2 as a whole can be increased. As the wiring 3 for resistance adjustment, in the above embodiments there are only two wires 3*a* and 3*b*; but there may be one, or two or more of such individual wires, or the entirety may be individual wires. By providing a plurality of wires for resistance adjustment, the range of adjustment of resistance values can be broadened.

Wiring 3 with such a branched shape can be obtained by forming a wiring pattern such that one or all of the heat-generating members are individually connected to wires 3 during patterning of the wiring 3 in the process shown in FIG. 3G of the above first embodiment. For example, of the plurality of heat-generating members arranged in parallel in the drawing, branch-shaped wiring can be formed such that two heat-generating members on the ends are connected independently to the connection portion; specifically, a pattern is formed such that the wiring 3 has the wires 3*a* and 3*b*. With regard to the material of the wiring, the above-described explanations may be referenced as appropriate.

By means of the eighth embodiment, when, for example, the resistance of the heater portion 2 is lowered due to scattering in the thickness of heat-generating members, so that the amount of heat generated is reduced, by using a laser or other means to cut the branched portion, the overall resistance of the heater portion 2 can be raised. Because a wiring portion formed on the substrate 1 and not on a heat-generating member is cut, there is no contact with the other wires or with the conductive portion during cutting, so that short-circuits and other problems can be prevented.

(Ninth Embodiment)

The heat-generating substrate of a ninth embodiment has a plurality of pairs of a heat-generating portion which generates heat from supplied power, and a depression portion provided below the heat-generating portion. These pairs of heat-generating portions and depression portions are formed integrally on the silicon substrate. Also, break grooves with, for example, wedge shapes at the tips, are formed between each of the pairs of heat-generating portions and depression portions. By this means each pair can easily be separated into chips without using special devices or methods.

Such break grooves may be formed on only one surface of the substrate, or may be formed at corresponding positions on both surfaces of the substrate. Particularly when using a thick substrate, by providing break grooves on both surfaces of the substrate, separation into chips can be performed easily. When using dicing to cut the substrate, cooling water is used to disperse the heat generated during cutting; but the pressure of the cooling water may cause damage to the heater portion. However, by means of the configuration of this embodiment, separation into chips is possible without using dicing or other special methods, and so pairs can be separated without damaging heater portions. Hence chips can be manufactured with good yield.

FIG. 14A through FIG. 14F and FIG. 15G through FIG. 15L are cross-sectional views of processes showing the manufacturing method of the heat-generating portion and break grooves of the heat-generating substrate of the ninth embodiment. In FIG. 14 and FIG. 15, each drawing on the right side is a cross-sectional view showing the process of formation of a break groove, and each drawing on the left side is an end-face diagram showing the process of formation of the heat-generating portion (heater portion), that is, a cross-sectional view corresponding to the direction of line B—B in FIG. 12A.

In the heat-generating substrate of this embodiment, a thermal oxide film is formed on the surface of the silicon substrate 1, and after patterning the thermal oxide film 11 of the heater surface 12 so as to remain only in the heater formation portion, a boron-doped layer is formed in the heater surface 12; then, a protective film 5 for etching is formed over the entire heater surface 12, and by performing dry etching and wet etching of the silicon substrate 1 from the heater surface 12, the heater portions 2 and break grooves 15 can be formed simultaneously. In this way, the heater portions 2 and break grooves 15 can be formed simultaneously using the same operations without requiring additional operations, so that efficiency is good.

Processes to manufacture the heat-generating substrate are explained based on FIG. 14A through FIG. 14F and FIG. 15G through FIG. 15L.

Figure 14A:
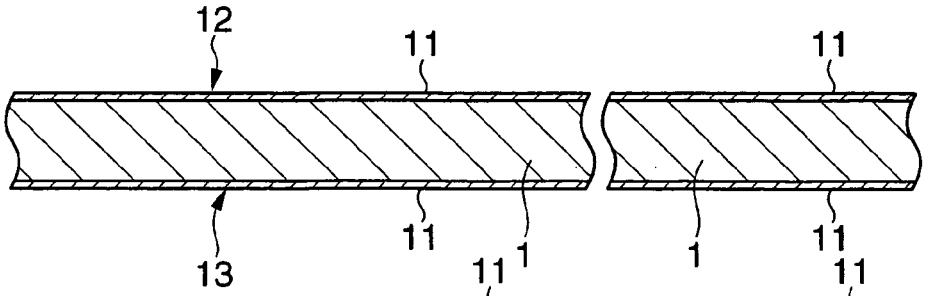
FIG. 14A through FIG. 14F are cross-sectional process diagrams showing the manufacturing method of the heat-generating portion and break groove of the heat-generating substrate of a ninth embodiment of this invention.

First, the heater surface 12 and rear surface 13 of the silicon substrate 1 are both mirror-polished, to fabricate a substrate of thickness, for example, 140 $\mu$m (FIG. 14A). Here on the silicon substrate 1, it is sufficient that the heater surface 12 be a mirror surface; both surfaces need not be mirror surfaces. Also, the substrate thickness is not limited to the above value, and various thicknesses can be used. This silicon substrate 1 is placed in a thermal oxidation furnace. Thermal oxidation treatment is then performed in an oxygen and steam atmosphere at, for example, 1075° C. for 4 hours. By this means a thermal oxide film ($SiO_2$) 11 is formed over the entirety of the silicon substrate 1 to a thickness of, for example, approximately 1.1 $\mu$m.

Figure 14B:
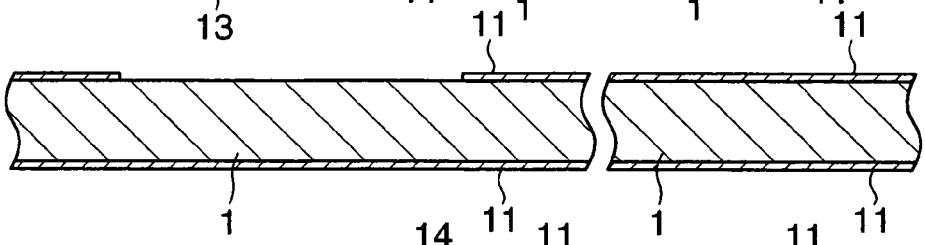

Then, both surfaces of the silicon substrate 1 are coated with resist (FIG. 14B). At this time, the heater surface 12 is patterned so as to expose the surface of the silicon substrate 1 in the portions where boron is to be diffused. The silicon substrate 1 with resist patterning on both surfaces is etched using a hydrofluoric acid aqueous solution to pattern the thermal oxide film ($SiO_2$) 11, and the resist is then stripped away from both surfaces of the silicon substrate 1.

Figure 14C:
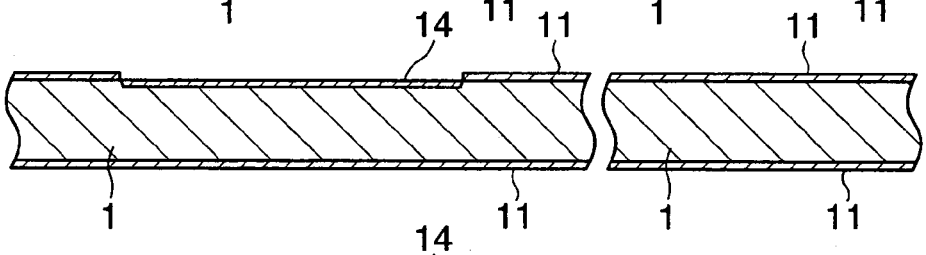

A boron diffusion plate (not shown) is opposed to the heater surface 12, and boron (B) is diffused into the portion with exposed silicon of the heater surface 12 by heat treatment at, for example, 1050° C. for 6 hours, to form the boron-doped layer 14 (FIG. 14C).

Figure 14D:
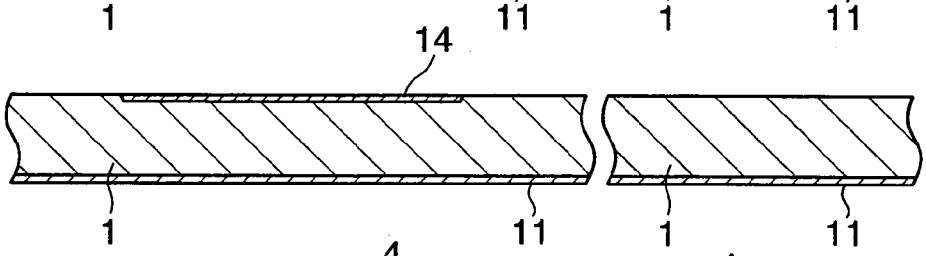

The rear surface 13 is protected with resist, and the thermal oxide film ($SiO_2$) 11 of the heater surface 12 is removed by etching with hydrofluoric acid aqueous solution, after which the resist is removed from the surface 13 (FIG. 14D).

Figure 14E:
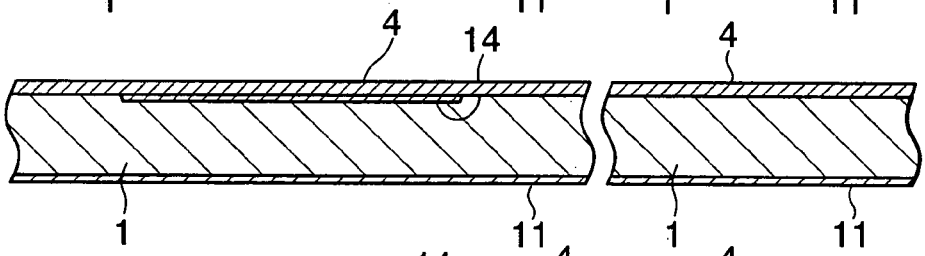

Then, a plasma CVD system is used to deposit a film at, for example, 360° C. on the silicon substrate 1 to form an insulating film 4 ($SiO_2$) of thickness, for example, 2 $\mu$m on the heater surface 12 (FIG. 14E).

Figure 14F:
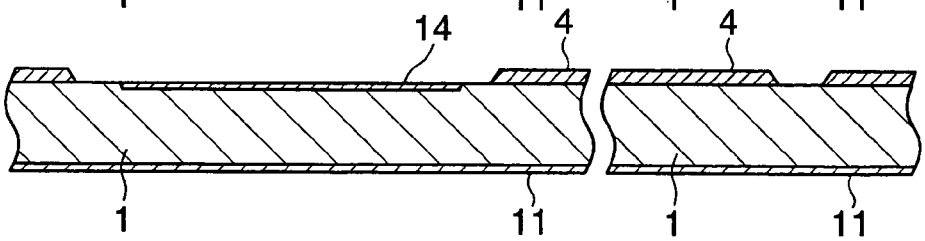

After coating with resist those portions other than the portions on which heaters and break grooves are to be formed, a hydrofluoric acid aqueous solution is used in wet etching to remove the insulating film 4 from the portions on which the heaters and break grooves are to be formed (FIG. 14F). Then the resist is stripped away.

Figure 15G:
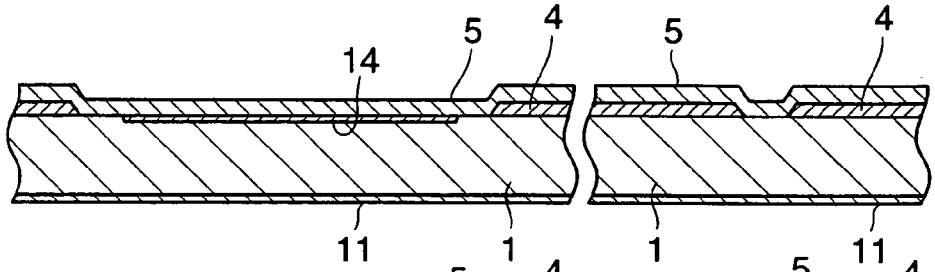
FIG. 15G through FIG. 15L are cross-sectional process diagrams showing the manufacturing method of the heat-generating portion and break groove of the heat-generating substrate of the ninth embodiment of this invention; and, FIG. 16 is a cross-sectional view showing one form of the break groove of the heat-generating substrate of the ninth embodiment of this invention.

The wiring 3 (not shown) is formed by patterning so as to be in contact with a portion of the boron-doped layer, and again film is deposited onto the silicon substrate 1 using a plasma CVD system at, for example, 360° C., to form a protective film ($SiO_2$) 5 on the heater surface 12 to a thickness of, for example, 2 $\mu$m (FIG. 15G).

Figure 15H:
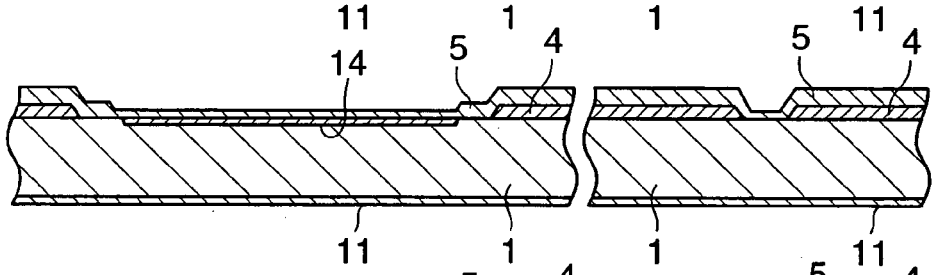

Resist is patterned to perform half etching with hydrofluoric acid aqueous solution of only the protective film ($SiO_2$) 5 on the portions on which the heaters of the heater surface 12 and break grooves are to be formed (FIG. 15H). Then the resist is stripped away.

Figure 15I:
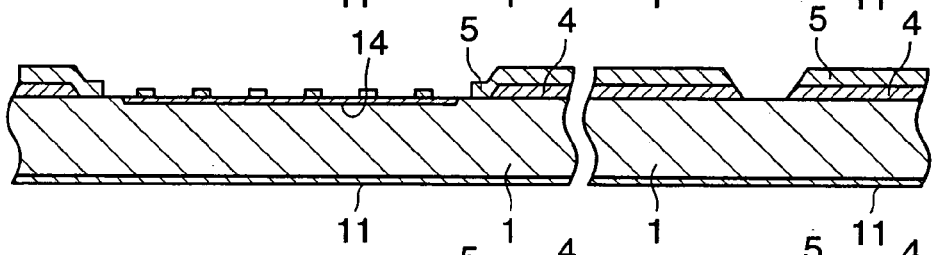

Both surfaces of the silicon substrate 1 are coated with resist, and after patterning the oxide film of the heater surface 12 into heater shapes and break groove shapes, the resist is removed (FIG. 15I).

Figure 15J:
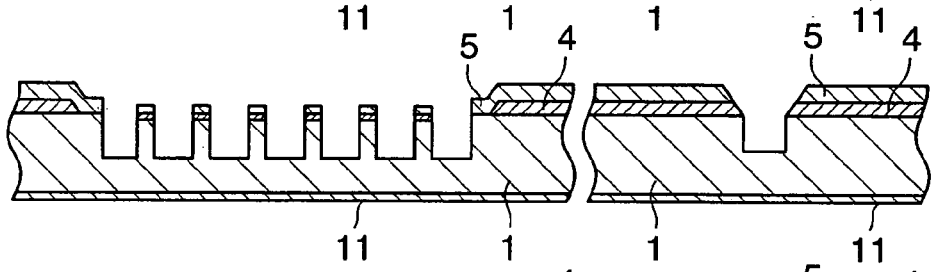

An ICP dry etching system is sued to perform dry etching of the heater surface 12 (FIG. 15J).

Figure 15K:
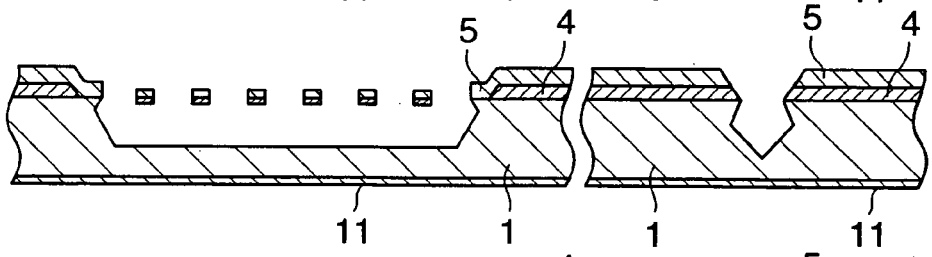

Next, the silicon substrate 1 is immersed in a potassium hydroxide aqueous solution with a weak concentration of 3 weight percent to remove the silicon remaining below the boron-doped film 14 (FIG. 15K). Through this process, the boron-doped layer 14 remains. Also, the tips of the break grooves 15 are wedge-shaped, in an easily cut shape.

Figure 15L:
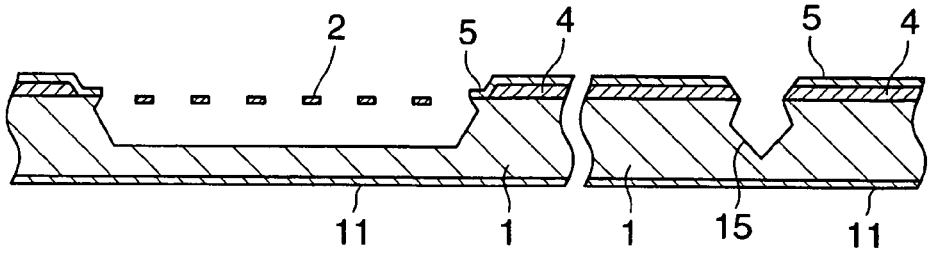

In order to remove only the protective film 5 ($SiO_2$) on the heaters 2, a hydrofluoric acid aqueous solution is used in half etching (FIG. 15L). This completes the heater portions.

Figure 16:
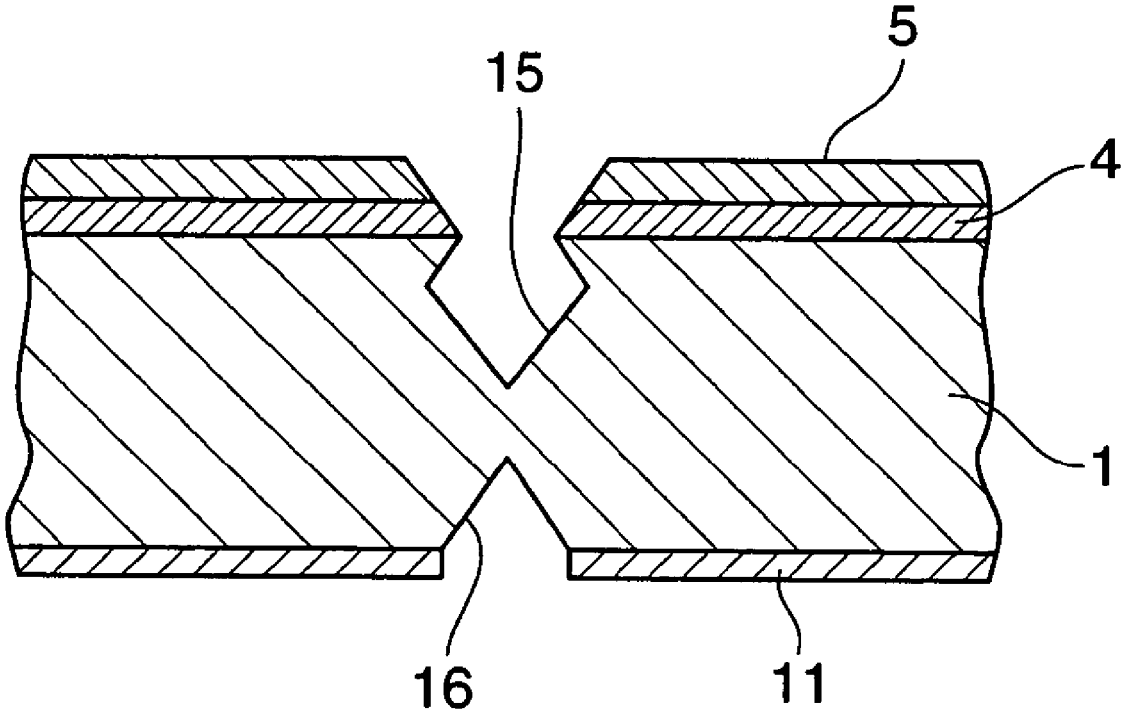

FIG. 16 is a cross-sectional view showing one form of the break grooves in a heat-generating substrate of this embodiment. As shown in the drawing, when the silicon substrate is thick, prior to the process (k) to etch the silicon substrate 1 with potassium hydroxide aqueous solution, the oxide film on the rear surface of the silicon substrate 1 may be patterned to form break grooves 16(V-shaped grooves) with wedge-shaped tips on the rear surface 13 also, in positions opposing the break grooves 15 formed in the heater surface. By forming break grooves in both surfaces of the silicon substrate, breaking into chips is made easier.

By means of the ninth embodiment, break grooves with wedge-shaped tips are formed between each of the pairs of heat-generating portions and depression portions, so that each pair is easily separated to obtain chips. Particularly when using a thick substrate, by providing break grooves in both surfaces of the substrate, separation into chips can be made easily. Separation of each pair can be performed without using dicing or other special methods, so that chips can be obtained without breaking heater portions, and yields are improved.

What is claimed is:

1. A heat-generating element made from a silicon imparted with conductivity through diffusion of an impurity, said silicon having at least one aperture portion, wherein said aperture portion is a slit with every corner portion removed or rounded.

2. A heat-generating substrate comprising:

a portion to generate heat using supplied power; and a depression portion provided below said portion to generate heat, wherein said portion to generate heat and said depression portion are formed integrally on a silicon substrate, wherein said silicon substrate is a semiconductor substrate of either P-type polarity or N-type polarity, and an impurity with polarity different from said silicon substrate is diffused in said portion to generate heat.

3. A heat generating substrate comprising:

a portion to generate heat using supplied power; and a depression portion provided below said portion to generate heat, wherein said portion to generate heat and said depression portion are formed integrally on a silicon substrate, wherein said silicon substrate is an N-type semiconductor substrate, and boron is diffused as the P-type impurity in said portion to generate heat.

4. A heat-generating substrate comprising:

a heat-generating portion, comprising one or a plurality of heat-generating members, traversing a fluid channel, wherein both ends of said heat-generating portion are supported by a substrate; and a wiring, formed on said substrate and being connected to both ends of said heat-generating members, wherein said wiring has a branched shape at a connection portion of said heat-generating members and said wiring so as to enable to supply power individually to at least a portion of said heat-generating members, and a resistance of said heat-generating portion can be adjusted by cutting the wiring at said branched shape.

* * * * *